US008869788B2

(12) United States Patent
Brooks et al.

(10) Patent No.: US 8,869,788 B2
(45) Date of Patent: Oct. 28, 2014

(54) LOW EMISSION WOODSTOVE

(75) Inventors: Corey Dewayne Brooks, Bryant, AL (US); Brandon Lane Barry, Sewanee, TN (US)

(73) Assignee: United States Stove Company, South Pittsburg, TN (US)

( * ) Notice: Subject to any disclaimer, the term of this patent is extended or adjusted under 35 U.S.C. 154(b) by 394 days.

(21) Appl. No.: 13/397,330

(22) Filed: Feb. 15, 2012

(65) Prior Publication Data

US 2013/0206129 A1 Aug. 15, 2013

(51) Int. Cl.
*F24C 1/00* (2006.01)

(52) U.S. Cl.
USPC ..... 126/77; 126/80; 126/112; 126/515; 126/516; 126/517; 126/518

(58) Field of Classification Search
USPC ..... 126/77, 80, 112, 515, 516, 517, 518; 110/211, 214; 431/8, 9, 10
See application file for complete search history.

(56) References Cited

U.S. PATENT DOCUMENTS

| | | | |
|---|---|---|---|
| 4,194,487 | A | 3/1980 | Cadwallader et al. |
| 4,556,044 | A | 12/1985 | Barsness et al. |
| 4,862,869 | A | 9/1989 | Hazard |
| 4,958,619 | A | 9/1990 | Kardas |
| 5,014,680 | A | 5/1991 | Siemer |
| 5,050,579 | A | 9/1991 | Melton et al. |
| 5,649,819 | A | 7/1997 | Karzone |
| 5,702,244 | A | 12/1997 | Goodson et al. |
| 5,873,356 | A | 2/1999 | Vossler et al. |
| 6,595,199 | B1 | 7/2003 | Andersen et al. |
| 7,686,011 | B1 | 3/2010 | Williams |
| 7,954,438 | B2 | 6/2011 | Brazier et al. |
| 2003/0192527 | A1 | 10/2003 | Buzzard et al. |
| 2008/0041357 | A1 | 2/2008 | Brown |
| 2009/0274985 | A1 | 11/2009 | Mcknight et al. |

OTHER PUBLICATIONS

Curkeet et al: "EPA Wood Heater Test Method Variability Study—Analysis of Uncertainty, Repeatability and Reproducibility based on the EPA Accredited Laboratory Proficiency Test Database"—pp. 1-43—Oct. 6, 2010.

*Primary Examiner* — Alfred Basichas
(74) *Attorney, Agent, or Firm* — I. C. Waddey, Jr.; Mark A. Pitchford

(57) ABSTRACT

The present disclosure provides woodstoves that, optionally, produce low emissions. In certain embodiments, the woodstove includes a housing, a firebox disposed in the housing, an air regulator and a secondary air pipe. The air regulator includes a primary air aperture configured to supply primary air to a fire located in the firebox, a plurality of secondary air apertures configured to supply secondary air to a combustible gas emitted by the fire, and a secondary air damper. The present disclosure also provides methods of operating such a woodstove. As measured according to Method 28 of the U.S. Environmental Protection Agency, the weighted average emission rate of the woodstove of certain embodiments of the invention is no greater than about 4.5 grams of particulate emissions per hour.

31 Claims, 14 Drawing Sheets

LOW EMISSION WOODSTOVE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND

1. Technical Field

The present disclosure relates to woodstoves and methods of operating a woodstove.

2. Background Art

Woodstoves have been used for hundreds of years to heat homes and other places where people gather. Although woodstoves are an economical source of heat, like most any machinery that relies on combustion, woodstoves produce particulate emissions.

BRIEF SUMMARY

In one aspect, the present disclosure provides a woodstove that includes a housing, a firebox disposed in the housing, an air regulator and a secondary air pipe. The air regulator includes a primary air aperture configured to supply primary air to a fire located in the firebox, a plurality of secondary air apertures configured to supply secondary air to a combustible gas emitted by the fire, and a secondary air damper. The secondary air damper has a low burn position in which the secondary air damper covers a maximum portion of the secondary air apertures and a high burn position in which the secondary air damper covers a minimum portion of the secondary air apertures. The secondary air pipe includes an entrance aperture configured to receive secondary air from the secondary air apertures located in the air regulator and allow secondary air to enter the secondary air pipe and an exit aperture configured to allow secondary air to exit the secondary air pipe and directly mix with the combustible gas. As measured according to Method 28 of the U.S. Environmental Protection Agency, the weighted average emission rate of the woodstove of certain embodiments of the invention is no greater than about 4.5 grams of particulate emissions per hour. Optionally, the air regulator further includes an air regulator floor and the primary and secondary air apertures located in the air regulator are located in the air regulator floor.

In certain embodiments, the present disclosure also provides a method for operating a woodstove. In certain embodiments, the method includes:

a) providing the woodstove;

b) flowing primary air through the primary air aperture and into the firebox;

c) igniting a fuel source to create a fire in the firebox emitting a combustible gas; and d) flowing secondary air through at least one of the secondary air apertures in the air regulator, through the entrance aperture in the secondary air pipe, into the secondary air pipe, and through the exit aperture in the secondary air pipe such that the secondary air exiting the exit aperture directly mixes with the combustible gas.

The steps illustrated above can be performed in any suitable order. For example, the order of steps b) and c) can be interchanged so that b) precedes c) or c) precedes b). In addition, two or more of the steps may be performed simultaneously. Further, the fuel source can be ignited before, during, or after the fuel source is placed in the firebox. Generally, the fuel source should be ignited in a fire safe enclosure for safety reasons and standards.

DETAILED DESCRIPTION

Figure 1:
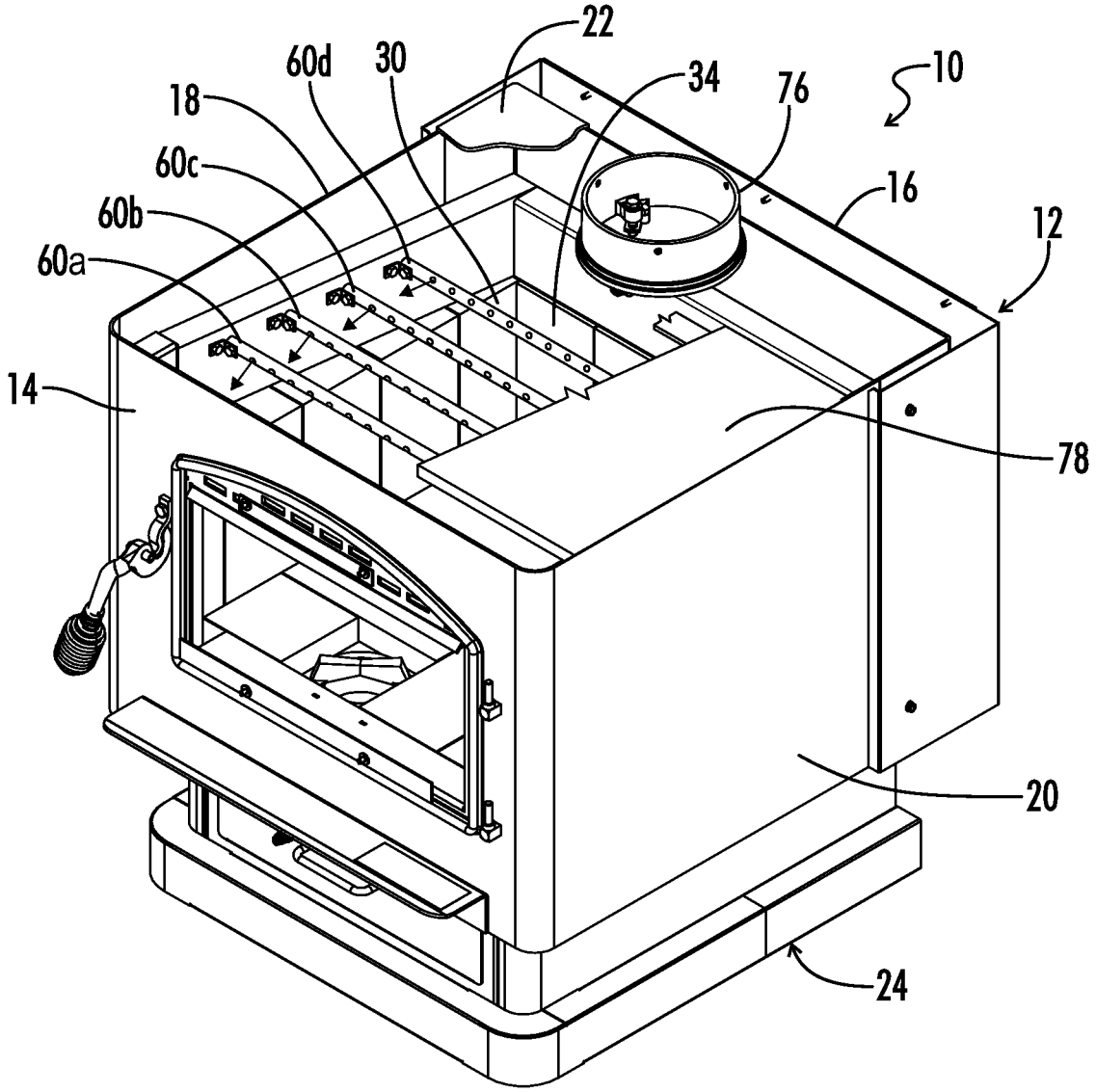
FIG. 1 illustrates an elevated side perspective view of a woodstove, wherein the frame and glass portion of the fuel loading door as well as the top portion of the woodstove have been removed; arrows illustrating secondary air exiting some of the exit apertures of the secondary air pipes have been provided.

FIG. 1-4 illustrate perspective views of one embodiment of a woodstove generally designated by the numeral 10. In the drawings, not all reference numbers are included in each drawing for the sake of clarity. Similarly, although air movement has been illustrated in FIGS. 1 and 3-6, not all air movement is shown in every drawing for the purpose of clarity. In addition, positional terms such as "upper," "lower," "side," "top," "bottom," etc. refer to the apparatus when in the orientation shown in the drawing.

Referring to FIGS. 1-4, the woodstove 10 includes a housing 12. The housing 12 may be any suitable shape or size. For example, as shown in FIGS. 1-4, the housing 12 is generally cubical and includes a front side 14, a rear side 16, left 18 and right 20 sides, a top 22, and a floor 24. The floor 24 is configured to position the woodstove 10 on a surface. However, it will be understood that the housing 12 can take on a variety of different shapes and sizes.

Figure 2:
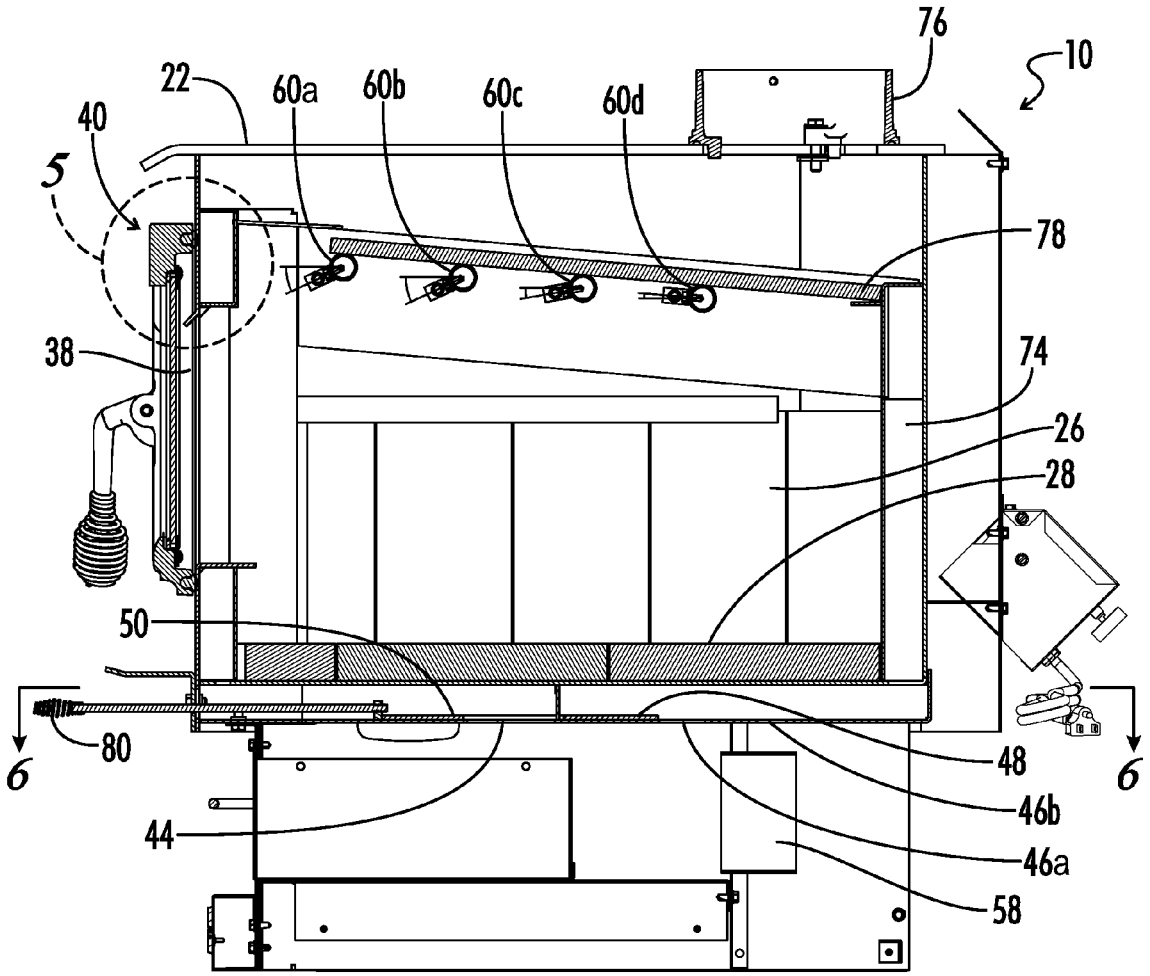
FIG. 2 illustrates a side, cross-sectional view of a woodstove; the primary air damper and the secondary air damper are in the high burn position.
Figure 3:
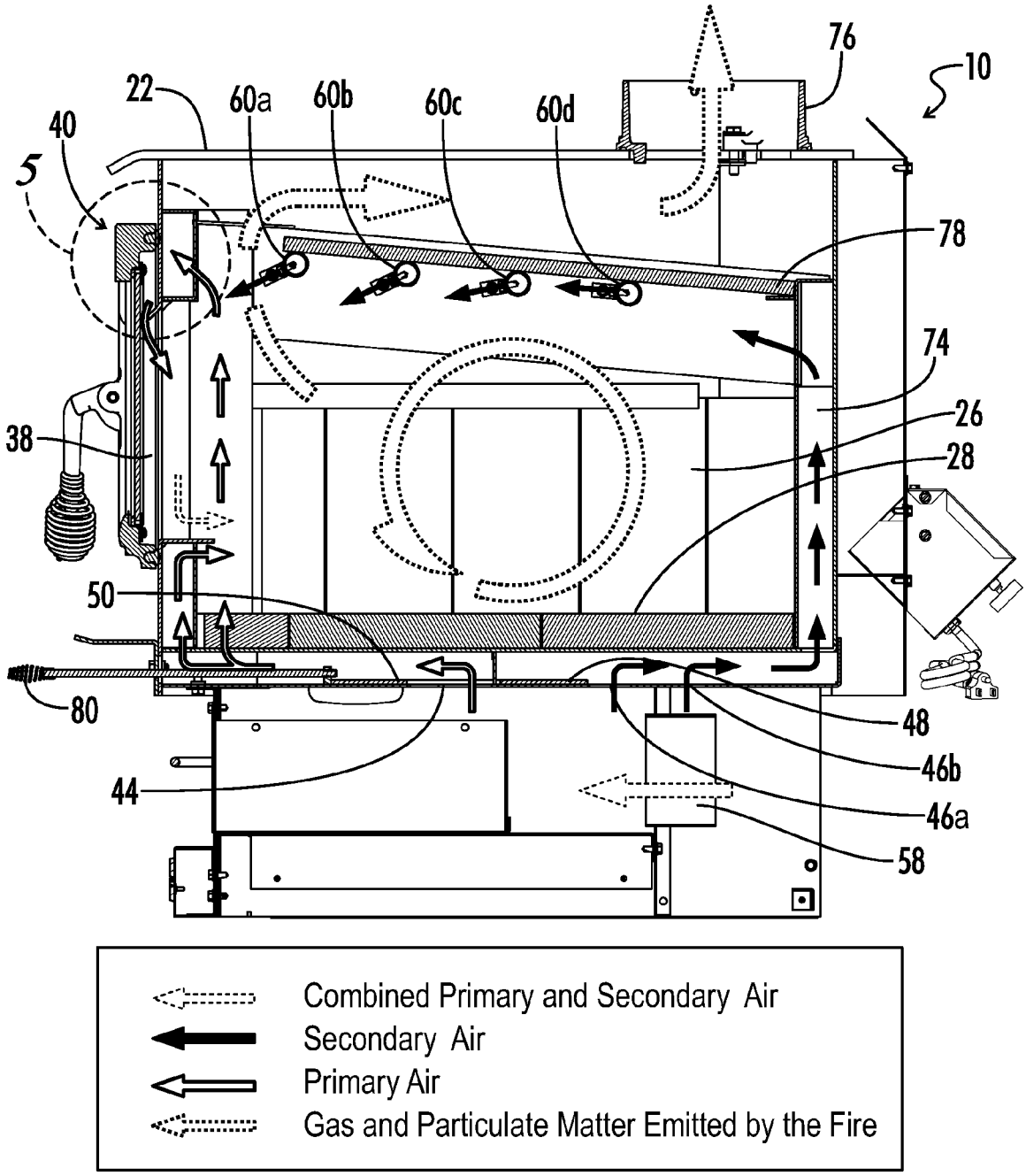
FIG. 3 illustrates a side, cross-sectional view of a woodstove, wherein arrows have been used to illustrate air movement in the woodstove; the primary air damper and the secondary air damper are in the high burn position.
Figure 4A:
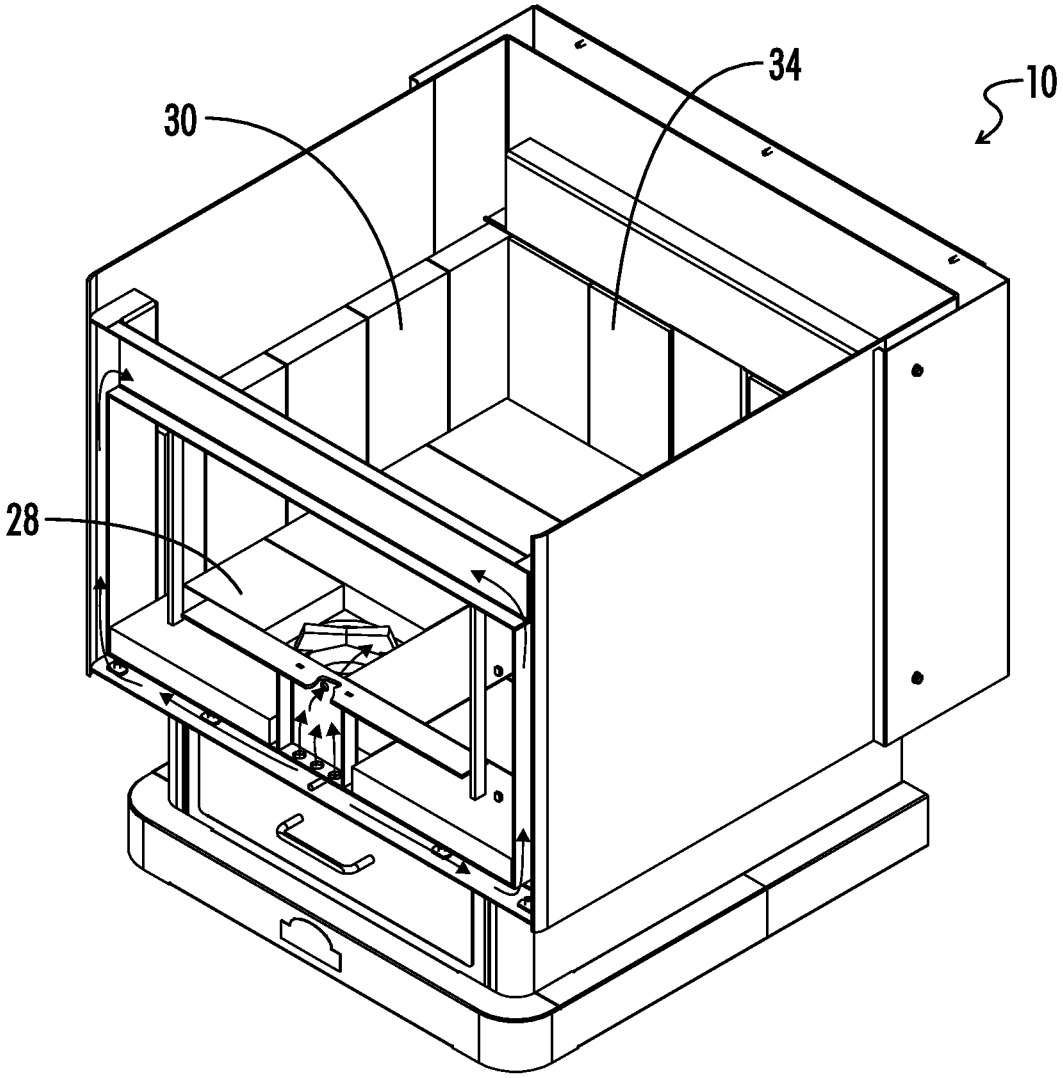
FIG. 4A illustrates an elevated side perspective of a woodstove wherein a top portion and a front portion of the woodstove as well as the secondary air pipes have been removed; arrows have been used to illustrate air movement in the woodstove.
Figure 4B:
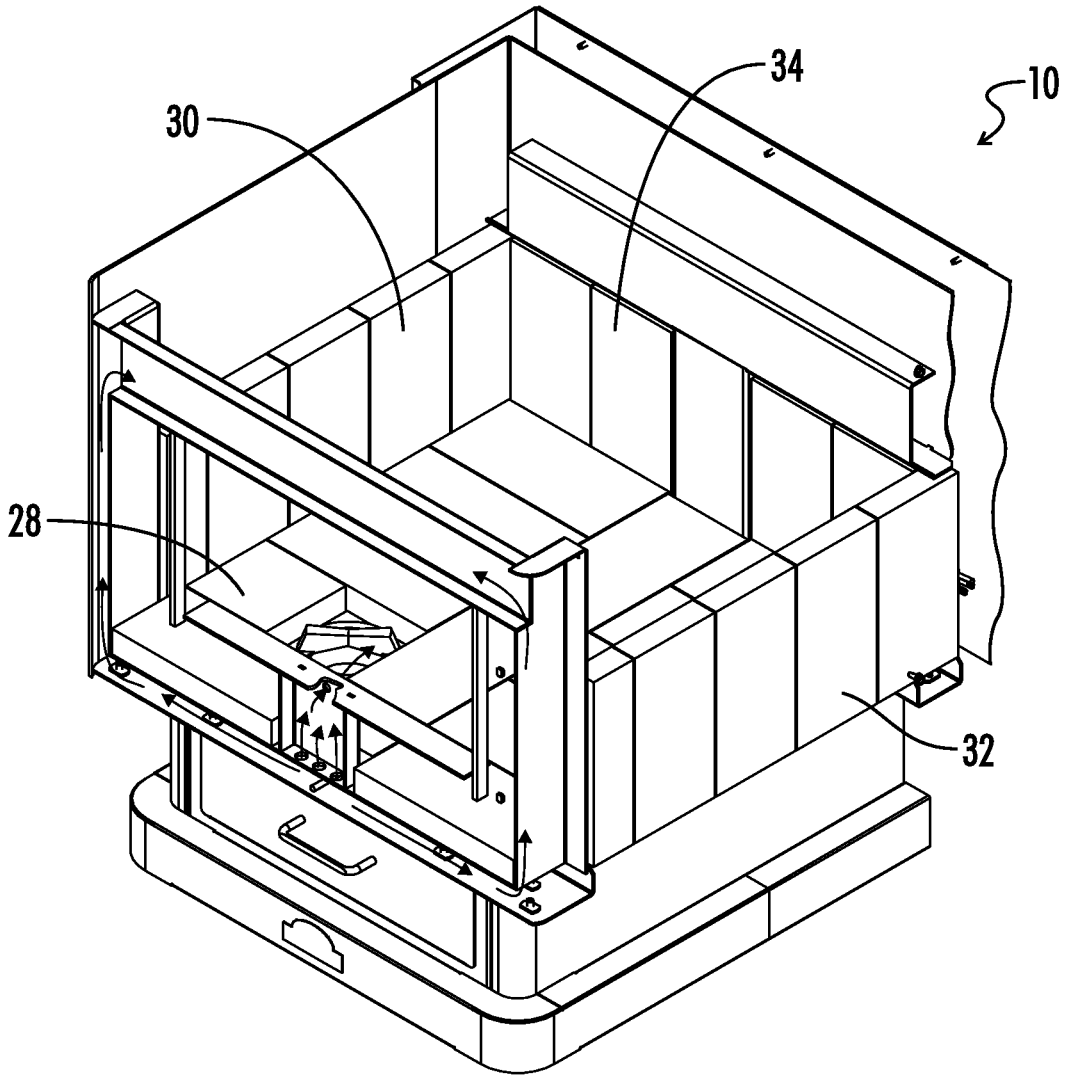
FIG. 4B illustrates an elevated side perspective of a woodstove wherein a top portion, a front portion and a right side portion of the woodstove as well as the secondary air pipes have been removed; arrows have been used to illustrate air movement in the woodstove.

Disposed within the housing is a firebox 26, as illustrated in FIGS. 2-4. The firebox 26 may be any suitable shape. For example, as illustrated in FIGS. 2-4, the firebox 26 includes a firebox floor 28 to receive a fuel source (e.g., wood), left and right firebox side walls 30 and 32 and a firebox rear wall 34. Optionally, the firebox floor 28, the left and right firebox side walls 30 and 32 and the firebox rear wall 34 are comprised of firebricks. As known to those of ordinary skill, a firebrick is a refractory brick used in lining fireboxes. Firebricks for use in the present invention may be made of any suitable material including, without limitation, fire clay, and optionally are able to withstand high temperatures, for example, temperatures of at least 2000° F. Optionally, the walls 30, 32, and 34 are generally flat. Optionally, as illustrated in FIGS. 2 and 3, the woodstove 10 further includes a ceramic fiberboard 78 disposed above the firebox floor 28 in the housing 12. It will be appreciated that when it is said that the ceramic fiberboard 78 is disposed "above" the firebox floor 28, it is meant that the ceramic fiberboard 78 is disposed above the firebox floor 28 when the woodstove 10 is in its normal orientation for use and placed on a flat surface (i.e., when the floor 24 of the woodstove housing 12 is placed on a flat surface such as a floor).

The ceramic fiberboard 78, if present, refracts heat downwards towards the firebox floor 28 when a fire is located in the firebox 26.

The woodstove 10 further includes a fuel loading opening 38, which forms part of the housing 12 and is configured so that a user may load a fuel source into the firebox 26. Optionally, the woodstove 10 further includes a fuel loading door 40 to open and close the fuel loading opening 38. Optionally, the fuel loading door 40 includes a glass portion so that a user may fully or partially view the firebox 26 when the fuel loading door 40 is closed.

Although particular configurations of fireboxes have been described above and illustrated in the drawings, it will be understood that the firebox 26 can take on a variety of different shapes and sizes. Optionally, as the woodstoves 10 of certain embodiments of the present invention produce low emissions notwithstanding the volume of their fireboxes 26, in certain embodiments, the firebox 26 has a usable volume of at least three cubic feet. For purposes of the present invention, the usable volume of the firebox 26 means the "usable firebox volume" as that term is defined in Method 28 Certification and Auditing of Wood Heaters (February 2000) (hereinafter referred to as "Method 28 of the U.S. Environmental Protection Agency") which is available at http://www.epa.gov/ttn/emc/promgate/m-28.pdf and is incorporated by reference herein in its entirety. As set forth in Method 28, "firebox height" means the vertical distance from the fuel loading door 40 or extending above the fuel loading door 40, if a fuel source could reasonably occupy that space, but not more than 2 inches above the top (peak height) of the fuel loading door 40, to either the firebox floor 28 if a permanent grate is either not present or allows a 1-inch diameter piece of wood to pass through the grate or to the top of the grate if the grate does not allow a 1-inch diameter piece of wood to pass through the grate. Firebox height is not necessarily uniform but must account for variations caused by internal baffles, air channels, or other permanent obstructions. "Firebox length" is defined as the longest horizontal firebox dimension that is parallel to a wall of the firebox 26. "Firebox width" is defined as the shortest horizontal firebox dimension that is parallel to a wall of the firebox 26. The usable firebox volume is then determined using the definitions for height, width and length, adjusted due to the presence of firebrick and other permanent fixtures as described below. Width and length dimensions are adjusted to extend to the metal wall of the woodstove 10 above the firebrick or permanent obstruction if the firebrick or obstruction extending the length of the side(s) 30 and 32 or back wall 34 extends less than one-third of the usable firebox height. The width or length dimensions inside the firebrick are used if the firebrick extends more than one-third of the usable firebox height. If a log retainer or grate is a permanent fixture and the manufacturer recommends that no fuel source be placed outside the retainer or grate, the area outside of the retainer or grate is excluded from the firebox volume calculations. The area above the ash lip is generally excluded if that area is less than 10 percent of the usable firebox volume. Otherwise, consumer loading practices are taken into account. For instance, if a fuel source is to be loaded front-to-back, an ash lip may be considered usable firebox volume. Areas adjacent to and above a baffle (up to two inches above the fuel loading opening 38) are included if four or more inches of horizontal space exist between the edge of the baffle and a vertical obstruction (e.g., sidewalls or air channels).

As illustrated in FIGS. 6, 8-9 and 14-15, the woodstove 10 further includes an air regulator 42. The air regulator 42 includes a primary air aperture 44 configured to supply primary air to a fire located in the firebox 26, and a plurality of secondary air apertures 46*a* and 46*b* configured to supply secondary air to a combustible gas emitted by the fire. Unless otherwise explicitly indicated, use of the singular herein will be understood to embrace the plural. Thus, optionally the air regulator 42 includes a plurality of primary air apertures 44. Optionally, the air regulator 42 is partially or fully disposed in the housing 12.

As used herein, the term "primary combustion" refers to combustion in which a fuel source (e.g. wood) burns within the firebox 26 and emits smoke including a combustible gas. It is contemplated that the emitted smoke may include a plurality of combustible gases mixed together. The term "primary air" refers to air supplied for primary combustion. The term "secondary combustion" refers to the burning of combustible gas emitted by primary combustion. The term "secondary air" refers to air supplied for secondary combustion and includes tertiary and higher order airs. When it is said that the air regulator 42 includes a primary air aperture 44 "configured to" supply primary air to a fire located in the firebox 26 and a plurality of secondary air apertures 46*a* and 46*b* "configured to" supply secondary air to a combustible gas emitted by a fire located in the firebox 26, it is meant that the primary air aperture 44 is capable of supplying primary air to a fire located in the firebox 26 and the plurality of secondary air apertures 46*a* and 46*b* are capable of supplying secondary air to a combustible gas emitted by a fire located in the firebox 26. In other words, a fire need not be presently burning in the firebox 26 and one or more of the apertures 44 and 46 may be covered by a moveable damper as described below. It will be further understood that, although the primary air aperture(s) 44 supply primary air to a fire located in the firebox 26, primary air entering through the primary air aperture(s) 44 need not be directly supplied to the fire, and instead, for example, the primary air may be transported through one or more pipes from the primary air aperture(s) 44 to the fire. Similarly, it will be understood that, although the secondary air apertures 46 supply secondary air to a combustible gas emitted by the fire, secondary air entering through the secondary air apertures 46 need not be directly supplied from the secondary air apertures 46 to the combustible gas, and instead, for example, the secondary air may be transported through one or more pipes to the combustible gas, as described below.

Figure 6:
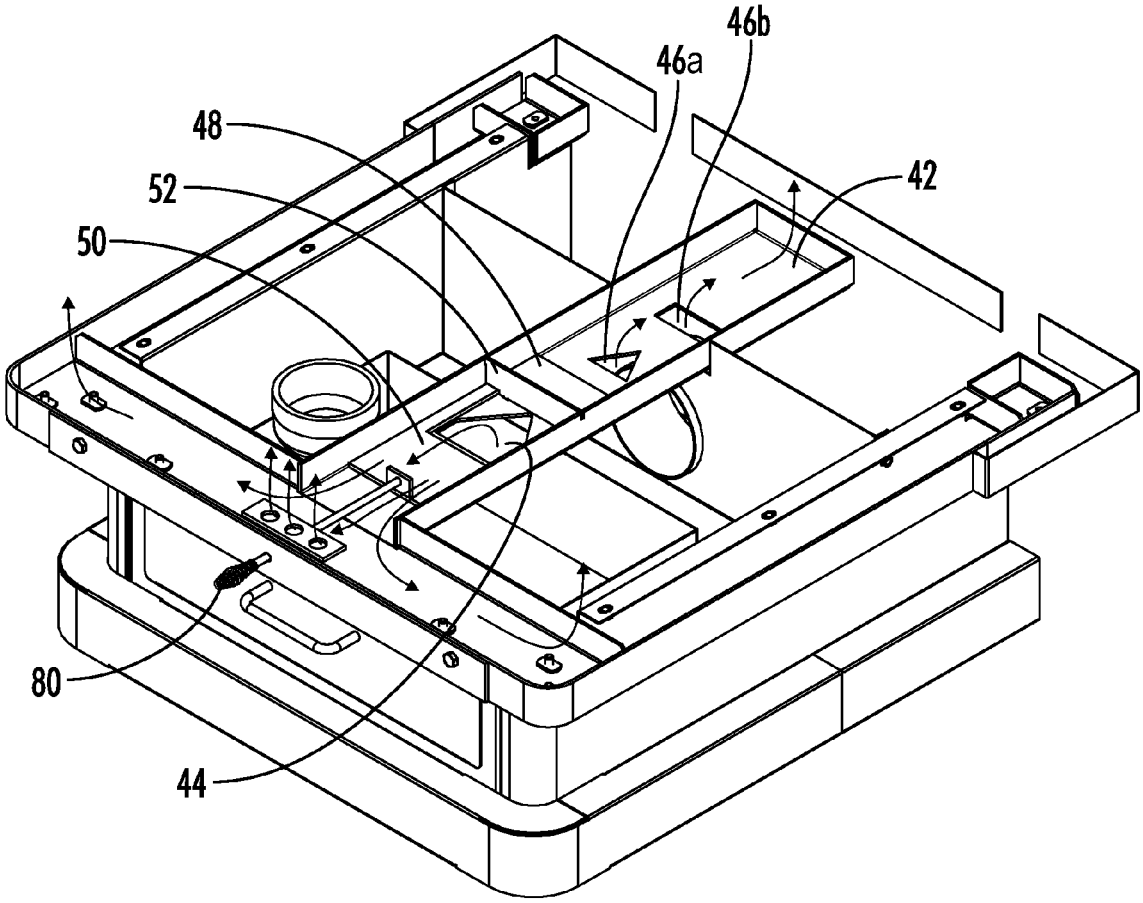
FIG. 6 illustrates an elevated perspective view of a section of a woodstove, taken along line 6-6 in FIG. 2, wherein arrows have been used to illustrate air movement in the woodstove; the primary air damper and the secondary air damper are in the high burn position.
Figure 7A:
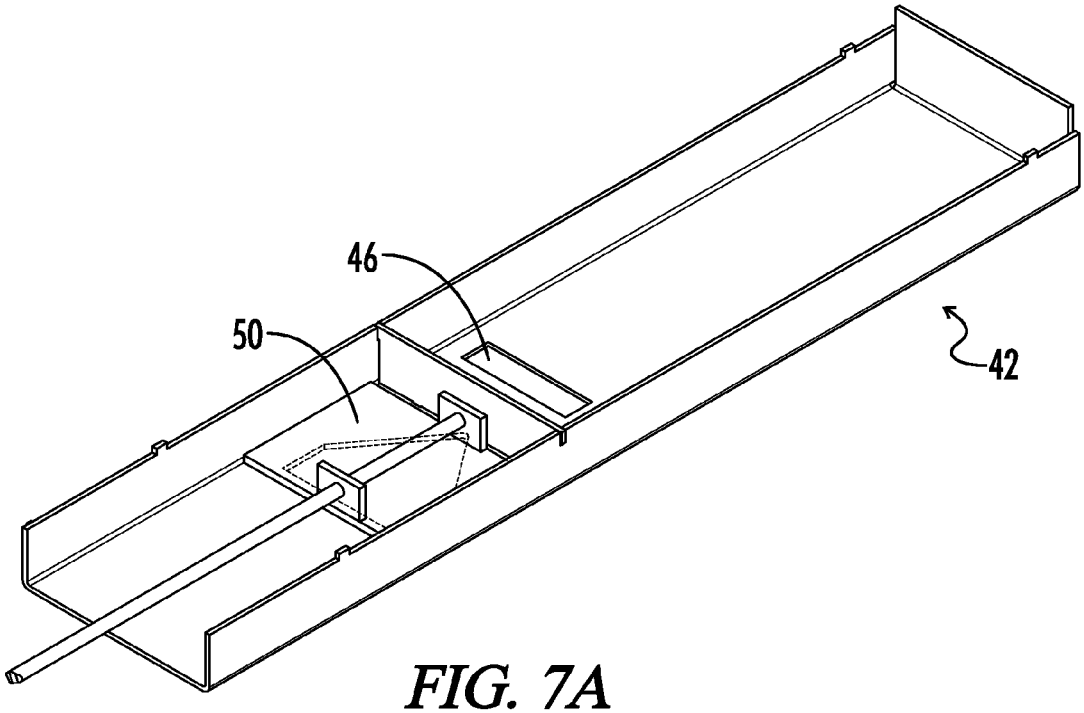
FIG. 7A (PRIOR ART)
FIG. 7A illustrates an elevated side perspective view of a prior art air regulator in which the air regulator includes a primary air damper in the low burn position.
Figure 7B:
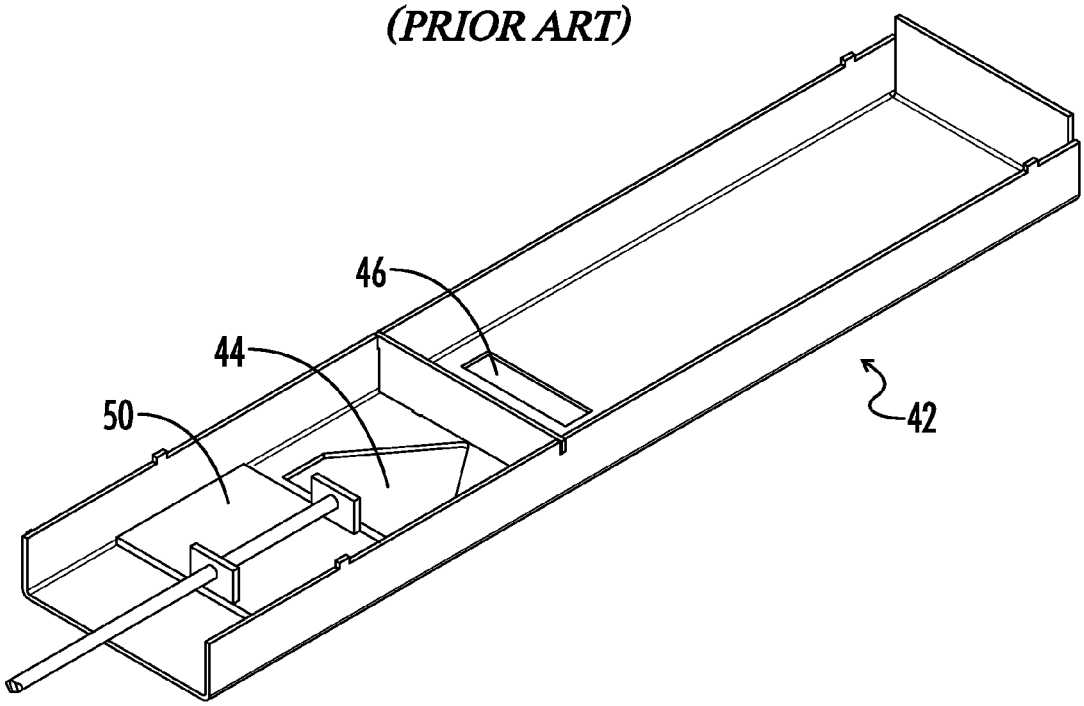
FIG. 7B (PRIOR ART)
FIG. 7B illustrates an elevated side perspective view of the prior art air regulator of FIG. 7A, wherein the primary air damper is in the high burn position.

As illustrated by comparing FIGS. 6, 8-9 and 14-15 with FIGS. 7A and 7B, it will be appreciated that, unlike certain prior art regulators, the air regulator 42 of certain embodiments of the present invention includes a plurality of secondary air apertures 46*a* and 46*b* so that additional secondary air can be supplied to mix with a combustible gas emitted by a fire located in the firebox 26 and, thus, particulate emissions emitted by the woodstove 10 can be reduced. In certain embodiments, the secondary air apertures 46*a* and 46*b* have different shapes such that as the speed, volume, or pressure of secondary air drawn or forced through the secondary apertures changes, the volume, speed, or pressure of the secondary air in the secondary air supply system changes as a function of the sizes, shapes, number, and position of the secondary air apertures. In certain embodiments, there is a single secondary air aperture (e.g., first secondary air aperture 46*a* of FIGS. 8A and 8B) having a size and shape varied by a damper or iris such as secondary air damper 48 as a function of a burn position or setting (e.g., low burn position, high burn position, or a position between the low burn position and the high burn position) of the woodstove 10.

In the exemplary embodiments shown in FIGS. 8 and 9, the primary air aperture 44 is pentagonal, the first secondary air aperture 46*a* is triangular and the second secondary air aperture 46*b* is rectangular. However, it will be understood that the apertures 44 and 46 may be any suitable shape or size. Optionally, the apertures 44 and 46 are shaped and sized to reduce the amount of particulate emissions emitted by the woodstove 10.

The air regulator 42 further includes a secondary air damper 48. The secondary air damper 48 has a low burn position in which the secondary air damper 48 covers a maximum portion of the secondary air apertures 46 and a high burn position in which the secondary air damper 48 covers a minimum portion of the secondary air apertures 46. In other words, in the low burn position, the secondary air damper 48 covers a maximum portion of the combined surface area of the secondary air apertures 46*a* and 46*b* and in the high burn position, the secondary air damper 48 covers a minimum portion of the combined surface area of the secondary air apertures 46*a* and 46*b*. Thus, it will be appreciated that when the secondary air damper 48 is in the high burn position, the air regulator 42 supplies a maximum amount of secondary air to a combustible gas emitted by a fire located in the firebox 26 and when the secondary air damper 48 is in the low burn position, the air regulator 42 supplies a minimum amount of secondary air to a combustible gas emitted by a fire located in the firebox 26.

Figure 8A:
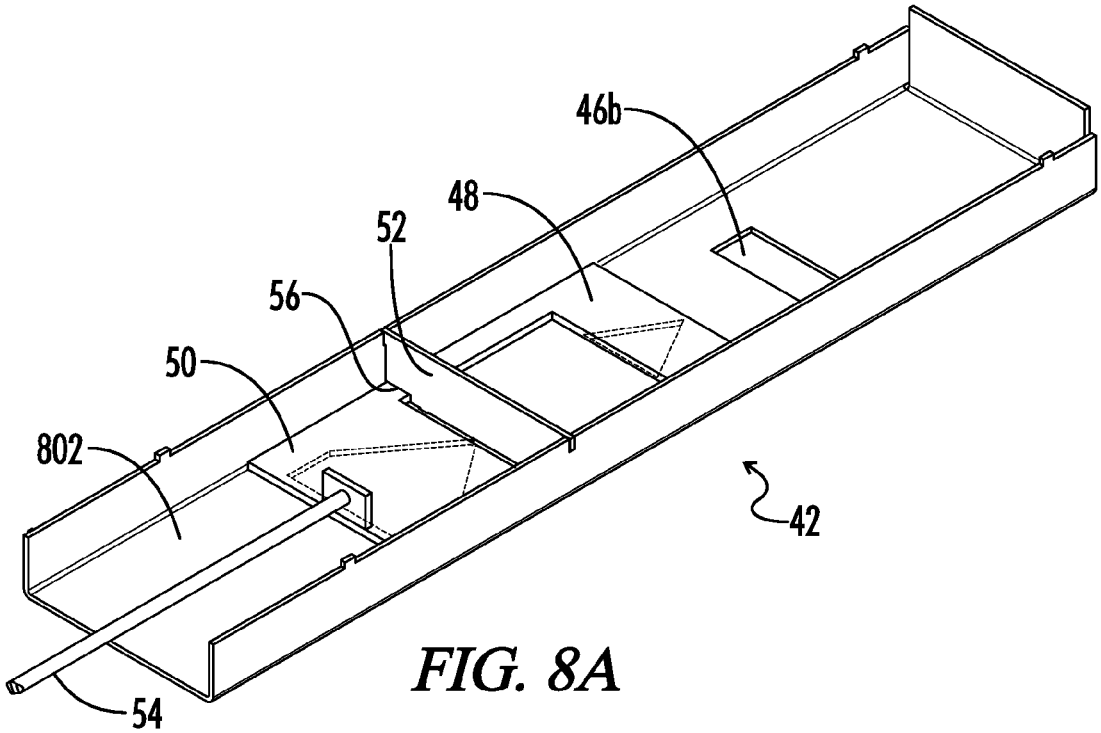
FIG. 8A illustrates an elevated side perspective view of an air regulator of one embodiment of the present invention, wherein the air regulator includes a primary air damper in the low burn position and a secondary air damper in the low burn position.
Figure 9A:
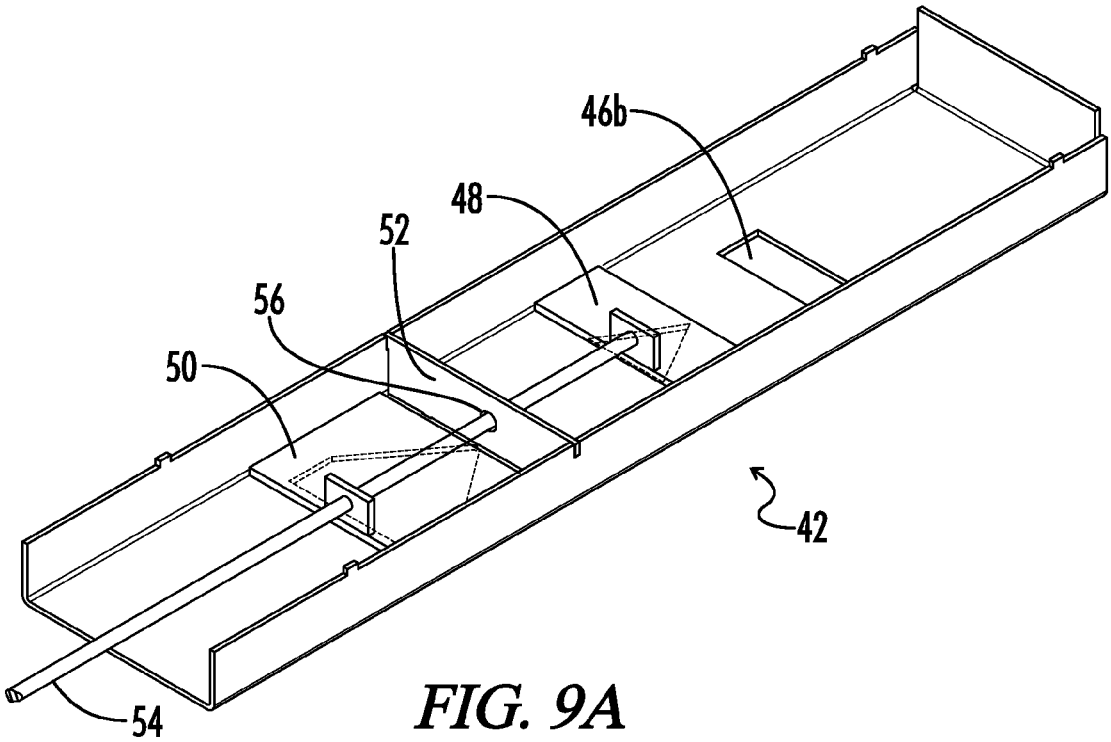
FIG. 9A illustrates an elevated side perspective view of an air regulator of another embodiment of the present invention, wherein the air regulator includes a primary air damper in the low burn position and a secondary air damper in the low burn position.

In some embodiments, as illustrated in FIGS. 8A and 9A, the secondary air damper 48 may be able to fully cover both the first and second secondary air apertures 46*a* and 46*b*. In the low burn position, the secondary air damper may only partially cover one or both of the secondary air apertures 46 and 46*b*.

Optionally, as shown in FIGS. 6, 8-9 and 14-15, the air regulator 42 includes an air regulator floor 802 and the primary and secondary air apertures 44 and 46 are located in the air regulator floor.

Optionally, the air regulator 42 further includes a primary air damper 50. If included, the primary air damper 50 has a low burn position in which the primary air damper 50 covers a maximum portion of the primary air aperture(s) 44 and a high burn position in which the primary air damper 50 covers a minimum portion of the primary air aperture(s) 44. In other words, in the low burn position, the primary air damper 50 covers a maximum portion of the combined surface area of the primary air aperture(s) 44 and in the high burn position, the primary air damper 44 covers a minimum portion of the combined surface area of the primary air aperture(s) 44. Thus, it will be appreciated that when the primary air damper 50 is in the high burn position, the air regulator 42 supplies a maximum amount of primary air to a fire located in the firebox 26 and when the primary air damper 50 is in the low burn position, the air regulator 42 supplies a minimum amount of primary air to a fire located in the firebox 26.

In some embodiments, the primary air damper 50 fully covers the primary air aperture(s) 44 in the low burn position. However, in other embodiments as illustrated in FIGS. 8A and 9A, the primary air damper 50 may only partially cover one or more of primary burn aperture(s) 44 in the low burn position.

In certain embodiments, the total surface area of the primary air aperture(s) 44 that is not covered by the primary damper 50 when the primary air damper 50 is in the high burn position is at least about five square inches and the total surface area of the secondary air apertures 46 that is not covered by the secondary air damper 48 when the secondary air damper 48 is in the high burn position is at least about three square inches.

Optionally, the air regulator 42 further includes a separation plate 52 extending from the air regulator floor 802 and the separation plate 52 creates a seal within the air regulator 42 so that primary air entering the air regulator 42 through the primary air aperture(s) 44 cannot mix with secondary air entering the air regulator 42 through the secondary air apertures 46 within the air regulator 42. However, it will be understood that although the separation plate 52 creates such a seal within the air regulator 42, in some embodiments, primary air entering the primary air aperture(s) 44 optionally can mix with secondary air entering the secondary air apertures 46 elsewhere within the housing 12.

Figure 8B:
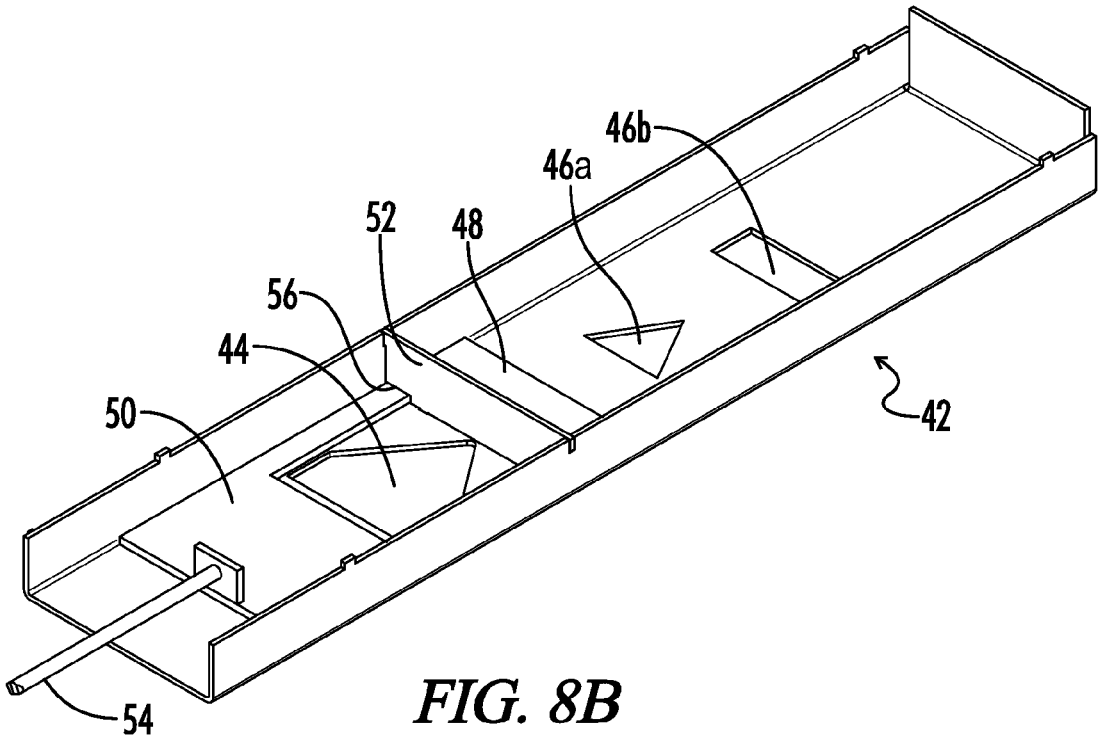
FIG. 8B illustrates an elevated side perspective view of the air regulator of FIG. 8A, wherein the primary air damper and the secondary air damper are in the high burn position.
Figure 9B:
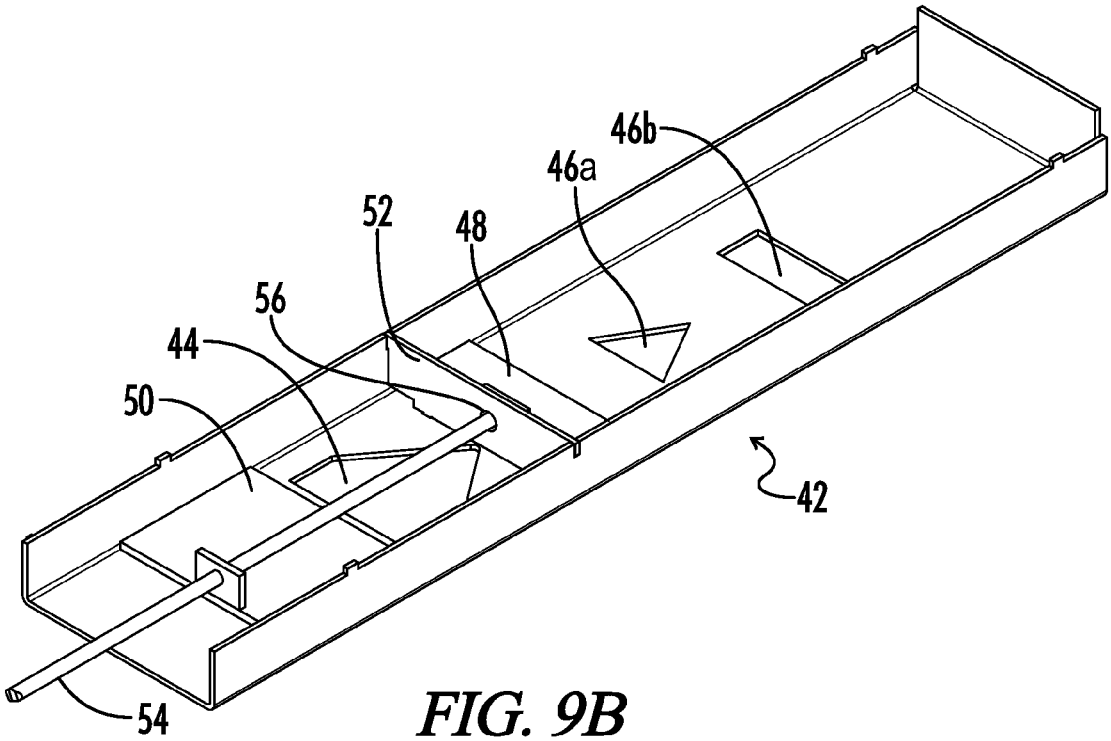
FIG. 9B illustrates an elevated side perspective view of the air regulator of the air regulator of FIG. 9A, wherein the primary air damper and the secondary air damper are in the high burn position.
Figure 10:
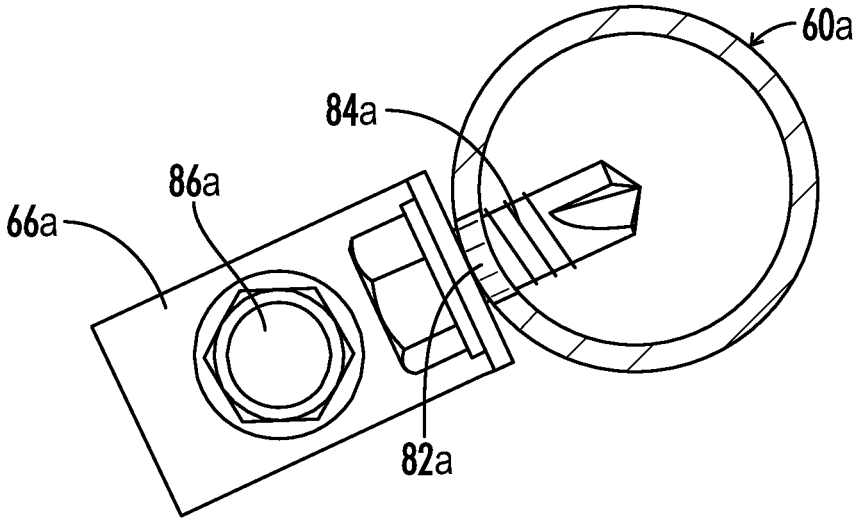
FIG. 10 illustrates a side, cross-sectional view of a secondary air pipe.
Figure 11:
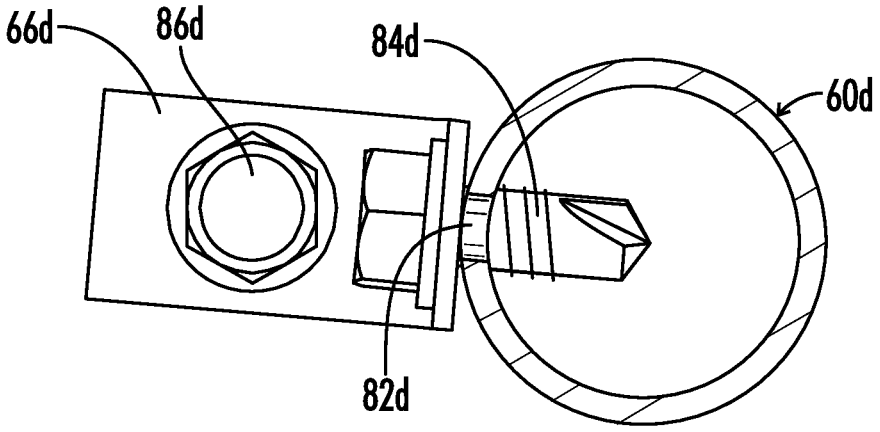
FIG. 11 illustrates a side, cross-sectional view of a secondary air pipe.

Optionally, the primary air damper 50 is operably connected to the secondary air damper 48 so that the primary air damper 50 and secondary air damper 48 can be moved simultaneously. In certain embodiments, as illustrated in FIGS. 8 and 9, a rod 54 configured to simultaneously move the primary air damper 50 and the secondary air damper 48 is attached to the primary air damper 50 and the secondary air damper 48. In one embodiment, as illustrated in FIGS. 9A and 9B, the separation plate 52 includes a separation plate opening 56 configured to receive the rod 54. Optionally, the rod 54 is shaped and sized to substantially seal the separation plate opening 56 such that the opening 56 does not alter a seal, if present, between the primary and secondary air apertures 44 and 46. In another embodiment, as illustrated in FIGS. 8A and 8B, the primary air damper 50 and the secondary air damper 48 are a single piece and, in such an embodiment, the separation plate opening 56 is configured to allow a portion of the single piece damper to pass through the opening 56. Optionally the single piece damper is shaped and sized to substantially seal the separation plate opening 56 such that the opening 56 does not alter a seal, if present, between the primary and secondary air apertures 44 and 46. Although particular configurations of the primary air damper 50, secondary air damper 48, and separation plate opening 56 have been described above, other suitable configurations are contemplated.

In certain embodiments, the primary air damper 50 and secondary air damper 48 are moved by an individual manually moving the dampers 50 and 48. In such an embodiment, optionally, the primary air damper 50 and secondary air damper are operably linked to a damper handle 80, as shown in FIGS. 2-4 and 6. In other embodiments, the dampers 50 and 48 are in communication with one or more electrical components (e.g., a power source, a processor, and an actuator) and the electrical component(s) causes the dampers 50 and 48 to move.

Optionally, as illustrated in FIGS. 2-3 and 6, the air regulator 42 is disposed below the firebox floor 28. It will be appreciated that when it is said that the air regulator 42 is disposed below the firebox floor 28, it is meant that the air regulator 42 is disposed below the firebox floor 28 when the woodstove 10 is in its normal orientation for use and placed on a flat surface (i.e., when the floor 24 of the woodstove housing 12 is placed on a flat surface such as a floor).

Air may enter the primary air and secondary air apertures 44 and 46 in any suitable manner. For example, in one embodiment, the woodstove 10 includes an air intake 58 through which primary and/or secondary air enters the woodstove 10 from the environment. Air from the environment includes air from immediately around the woodstove 10 as well as air supplied from outside a structure enclosing the woodstove 10, and may be naturally aspirated or forced via a blower system. In such an embodiment, one or more of the apertures 44, 46*a* and 46*b* may be in gaseous communication with the air intake 58. Optionally, as illustrated in FIGS. 2, 3 and 6, one or more of the apertures 44, 46*a* and 46*b* may be formed in the housing 12 so that primary and/or secondary air enters one or more of the apertures 44, 46*a*, and 46*b* directly from the environment.

For purposes of the present invention, the term "in gaseous communication with" refers to components in which a gas is able to travel from one component, directly or indirectly, to the other component as well as components in which a gas is able to travel from one component, directly or indirectly, to the other component after an obstruction (e.g., a damper) between the components is moved. In other words, the term "in gaseous communication with each other" refers to components that are actually in gaseous communication with each other as well as components that are capable of being in gaseous communication with each other.

The woodstove 10 further includes one or more secondary air pipes 60 (i.e., first secondary air pipe 60*a*, second secondary air pipe 60*b*, third secondary air pipe 60*c*, and fourth secondary air pipe 60*d*). Optionally, the secondary air pipe(s) 60*a*, 60*b*, 60*c*, and 60*d* are fully or partially disposed in the housing 12. As illustrated in FIGS. 1-3 and 10-13, the secondary air pipe(s) 60*a*, 60*b*, 60*c*, and 60*d* each include (a) an entrance aperture(s) 62 (i.e., entrance aperture 62*a* in a first secondary air pipe 60*a* and entrance aperture 62*d* in a fourth secondary air pipe 60*d*) configured to receive secondary air from the secondary air apertures 46 located in the air regulator and thereby allow secondary air to enter the secondary air pipe 60 and (b) an exit aperture(s) 64 (i.e., exit aperture 64*a* in first secondary air pipe 60*a* and exit aperture 64*d* in fourth secondary air pipe 60*d*) configured to allow secondary air to exit the secondary air pipe 60 and thereby allow secondary air to directly mix with a combustible gas emitted by a fire located in the firebox 26. As used herein, the term "directly mix" means that there is no intervening pipe that transports secondary air from the exit aperture 64 to the combustible gas. Again, it will be appreciated that the term "configured to" in this context means "capable of" and a fire need not be presently burning in the firebox 26 and one or more of the apertures 44 and 46 may be covered by a moveable damper as described above.

Optionally, the secondary air pipes 60*a*, 60*b*, 60*c*, and 60*d* are generally cylindrical in shape. However, it will be appreciated that other shapes of the secondary air pipe(s) are possible.

Figure 12:
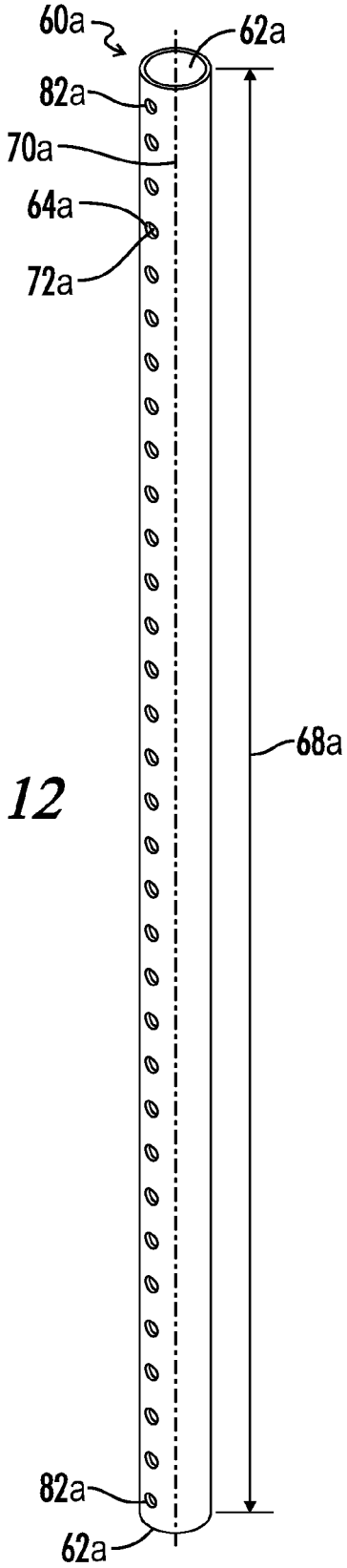
FIG. 12 illustrates a top, perspective view of a secondary air pipe.
Figure 13:
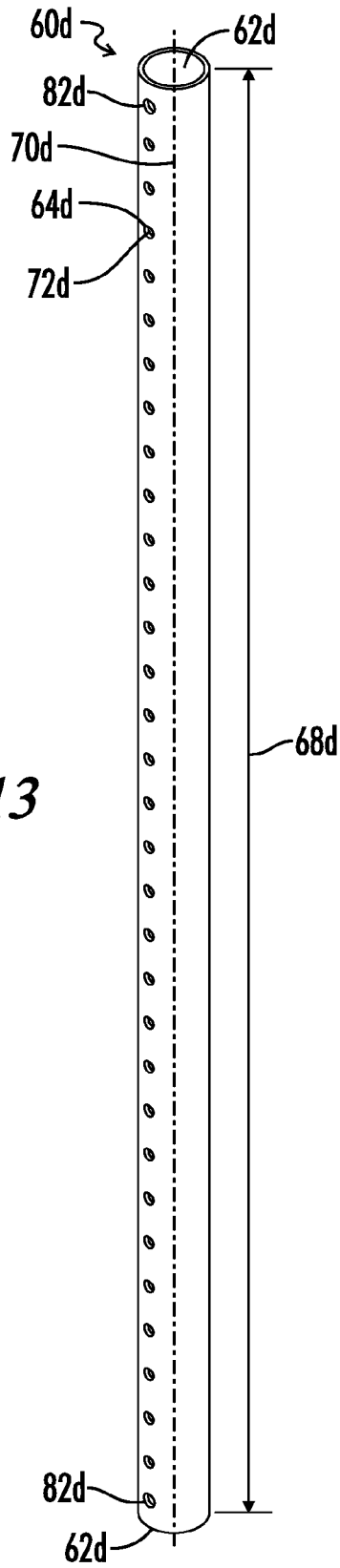
FIG. 13 illustrates a top, perspective view of a secondary air pipe.
Figure 14:
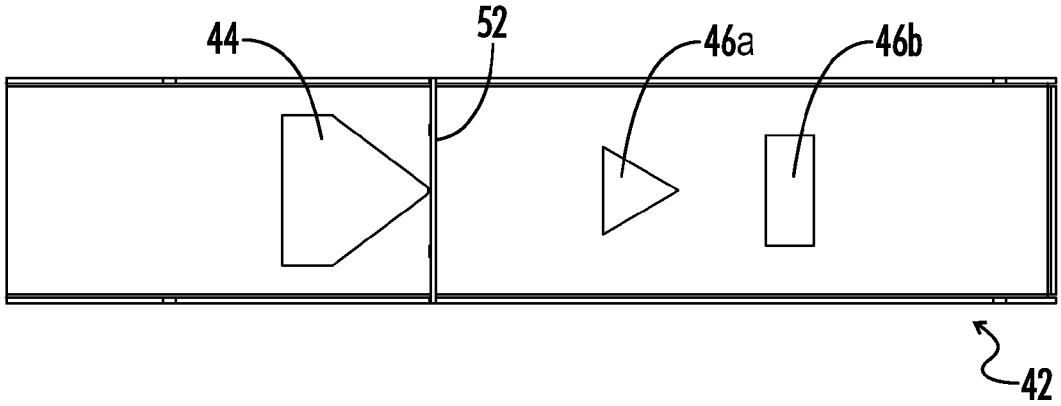
FIG. 14 illustrates a top, plan view of an air regulator of one embodiment of the present invention; the primary air damper and the secondary air damper have been removed.
Figure 15:
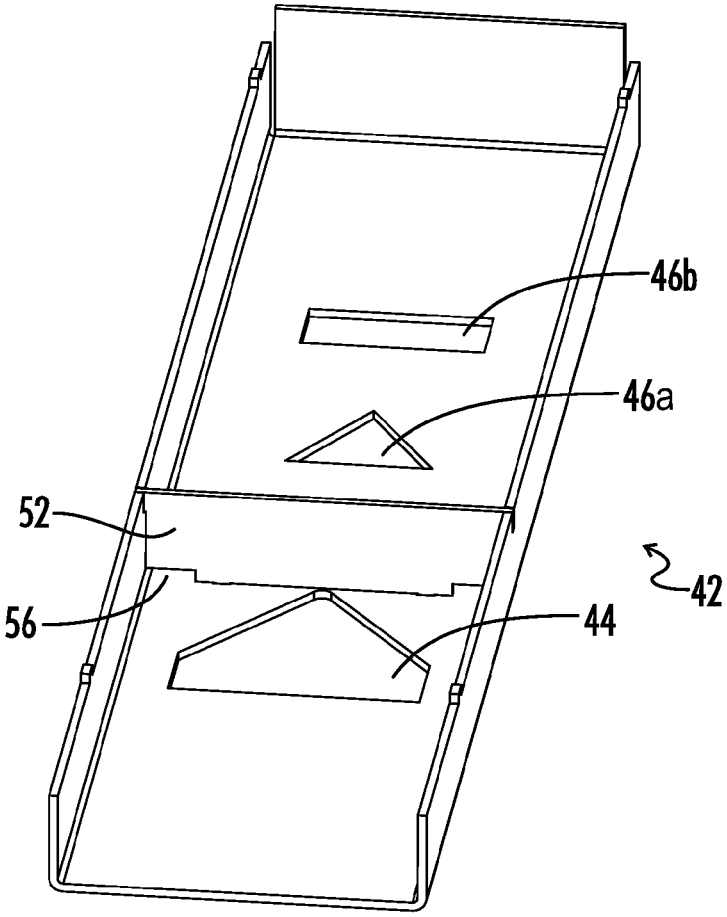
FIG. 15 illustrates an elevated front perspective view of an air regulator of one embodiment of the present invention; the primary air damper and the secondary air damper have been removed.

In certain embodiments, the secondary air pipe(s) each include a plurality of exit apertures 64, as illustrated in FIGS. 1, 12 and 13. In FIG. 1, arrows showing secondary air exiting only some of the exit apertures 64 have been provided for the sake of clarity.

Optionally, as illustrated in FIGS. 1-3, the secondary air pipe(s) 60*a*, 60*b*, 60*c*, and 60*d* are disposed above the firebox floor 28. Optionally, the secondary air pipe(s) 60*a*, 60*b*, 60*c*, and 60*d* are disposed above the firebox floor 28 at a height of between about 12.8 and about 13.4 inches relative to the firebox floor 28. It will be appreciated that when it is said that the secondary air pipe(s) 60*a*, 60*b*, 60*c*, and 60*d* are disposed "above" the firebox floor 28, it is meant that the secondary air pipe(s) 60*a*, 60*b*, 60*c*, and 60*d* are disposed above the firebox floor 28 when the woodstove 10 is in its normal orientation for use and placed on a flat surface (i.e., when the floor 24 of the woodstove housing 12 is placed on a flat surface such as a floor). Optionally, the secondary air pipe(s) 60*a*, 60*b*, 60*c*, and 60*d* are located between the firebox floor 28 and the ceramic fiberboard 78, as shown in FIGS. 2-3.

Optionally, if the secondary air pipe(s) 60*a*, 60*b*, 60*c*, and 60*d* are disposed above the firebox floor 28, the secondary air pipe(s) 60 are positioned such that, for a majority of the exit apertures 64, secondary air immediately exiting the exit aperture 64 is directed at an angle of between about −35 degrees and about +15 degrees relative to the ground when the floor 24 of the woodstove housing 12 is positioned on a flat surface (e.g., the ground), wherein a negative angle represents secondary air directed downwardly relative to the ground and a positive angle represents secondary air directed upwardly relative to the ground. Optionally, the secondary air pipe(s) 60*a*, 60*b*, 60*c*, and 60*d* span across the interior of the housing 12, as shown in FIG. 1.

In certain embodiments, as shown in FIGS. 1-2 and 12-13, the secondary pipe(s) 60*a*, 60*b*, 60*c*, and 60*d* are generally cylindrical in shape and each secondary air pipe 60 includes a secondary air pipe length 68 and a plurality of exit apertures 64, and the exit apertures 64 are spaced along the secondary air pipe length 68. In such embodiments, each cylindrical-shaped, secondary air pipe(s) 60 further includes a longitudinal axis 70 (e.g., first longitudinal axis 70*a* of the first secondary air pipe 60*a* and fourth longitudinal axis 70*d* of the fourth secondary air pipe 60*d*) and each exit aperture 64 includes an exit aperture center 72 (e.g., exit aperture center 72*a* of the first secondary air pipe 60*a* and exit aperture center 72*d* of the fourth secondary air pipe 60*d*). Optionally, the secondary air pipe(s) 60 is positioned such that, for a majority of the exit apertures 64, a line drawn perpendicularly from the secondary air pipe longitudinal axis 70 through the center 72 of the given exit aperture 64 is at an angle of between about −35 degrees and about +15 degrees relative to the ground when the floor 24 of the woodstove housing 12 is placed on a flat surface, wherein a negative angle represents secondary air directed downwardly relative to the ground and a positive angle represents secondary air directed upwardly relative to the ground, as shown in FIG. 2.

In one particular embodiment, the woodstove 10 includes four cylindrical secondary air pipes, designated 60*a*, 60*b*, 60*c*, and 60*d*, with the letters a-d running from the front to the rear of the woodstove 10, as illustrated in FIGS. 1-3. For ease of reference below and in the drawings, the components of each secondary air pipe (e.g., the entrance and exit apertures and longitudinal axis) will be similarly designated with the letters a, b, c, and d to indicate which secondary air pipe the component corresponds to. Each secondary air pipe 60*a*, 60*b*, 60*c*, and 60*d* includes a plurality of exit apertures 64 spaced along the secondary air pipe length 68, as well as a longitudinal axis 70. The first front secondary air pipe 60*a* (i.e., the front-most secondary air pipe) is positioned in the housing 12 such that lines drawn perpendicularly from the secondary air pipe longitudinal axis 70*a* through the center 72*a* of each exit aperture 64*a* of secondary air pipe 60*a* are at an angle of from about −30 degrees to about −20 degrees relative to the ground, the second front secondary air pipe 60*b* is positioned in the housing 12 such that lines drawn perpendicularly from the secondary air pipe longitudinal axis 70*b* through the center 72*b* of each exit aperture 64*b* of secondary air pipe 60*b* are at an angle of from about −30 degrees to about −20 degrees relative to the ground, the first rear secondary air pipe 60*c* is positioned in the housing 12 such that lines drawn perpendicularly from the secondary air pipe longitudinal axis 70*c* through the center 72*c* of each exit aperture 64*c* of secondary air pipe 60*c* are at an angle of from about −5 degrees to about −15 degrees relative to the ground, and the second rear secondary air pipe 60*d* (i.e., the rear-most secondary air pipe) is positioned in the housing 12 such that a line drawn perpendicularly from the secondary air pipe longitudinal axis 70*d* through the center 72*d* of each exit aperture 64*d* of secondary air pipe 60*d* are at an angle of from about 0 degrees to about +10 degrees relative to the ground, wherein a negative angle represents a line directed downwardly relative to the ground and a positive angle represents a line drawn upwardly relative to the ground.

In certain embodiments, the secondary air pipe(s) 60 is attached, directly or indirectly, to the housing 12 and, in such embodiment, the secondary air pipe 60 can be attached to the housing 12 in any suitable manner. Optionally, as illustrated FIGS. 1 and 10-11, the secondary air pipe(s) 60 is attached to a bracket 66 through the use of a pipe fastener(s) 84 (e.g., a bolt, a screw, a nail or an adhesive) and the bracket 66 is attached to the housing 12 through the use of a bracket fastener(s) 86 (e.g., a bolt, a screw, a nail or an adhesive). Optionally, the secondary air pipe(s) 60 includes a pipe fastener aperture 82 configured to receive the pipe fastener(s) 84.

Figure 4C:
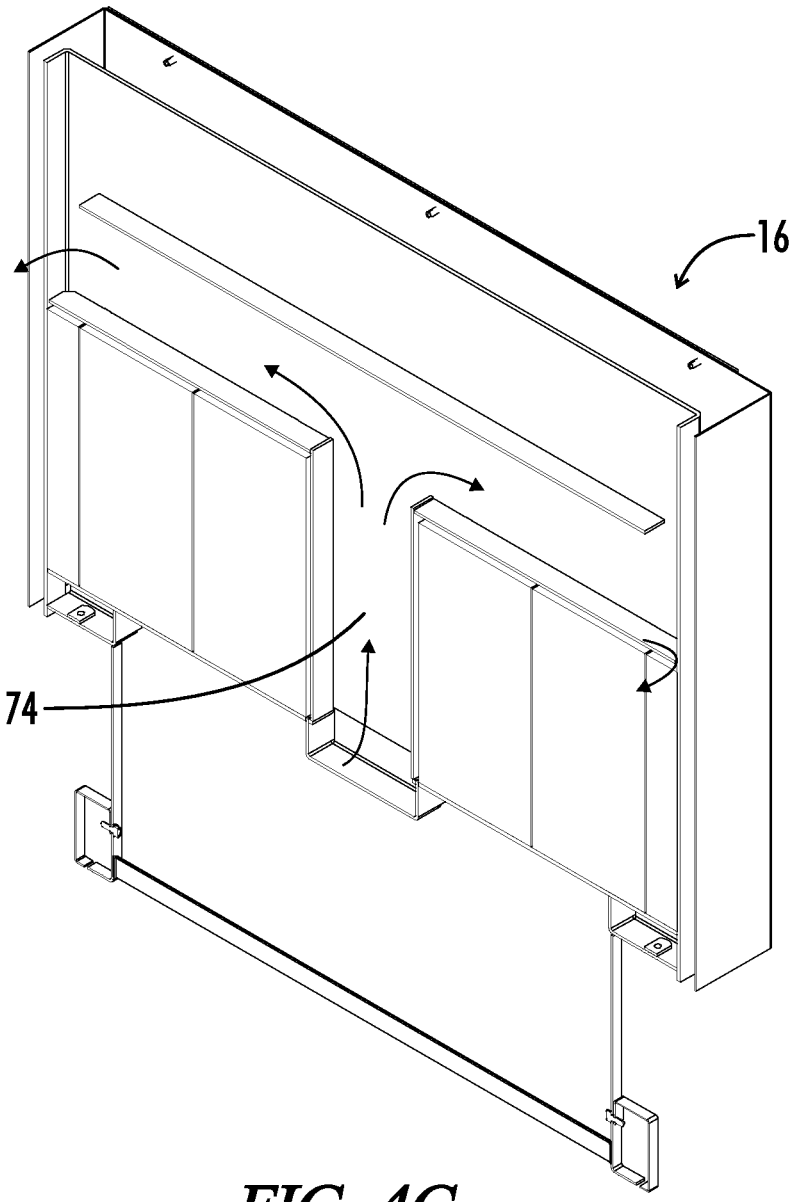
FIG. 4C illustrates an elevated side perspective view of a rear portion of a woodstove; arrows have been used to illustrate air movement.

The secondary air pipe entrance aperture(s) 62 receives secondary air, directly or indirectly, from the secondary air apertures 46 located in the air regulator 42. Optionally, as illustrated in FIG. 4C, the woodstove 10 further includes a secondary air passage 74 that transports secondary air from the secondary air apertures 46 located in the air regulator 42 to the entrance aperture(s) 62 in the secondary air pipe(s) 60. In one particular embodiment, illustrated in FIGS. 3 and 4C, secondary air entering the secondary air apertures 46 travels upwards through the secondary air passage 74 and towards the right and left sides of the woodstove 10 and then through the entrance aperture(s) 62 and into the secondary air pipe(s) 60 where it is then fed through the exit aperture(s) 64 so that the secondary air exiting the exit aperture(s) 64 can directly mix with a combustible gas emitted by a fire located in the firebox 26. Optionally, the location of the secondary air passage 74 within the woodstove 10 is chosen so that the secondary air is warmed by the fire prior to mixing with the combustible gas emitted by the fire.

Optionally, the size, shape, and number of the primary air aperture(s) 44 and the secondary air apertures 46 of the air regulator 42, the size, shape and number of the entrance and exit apertures 62 and 64, respectively, of the secondary air pipe(s) 60, the size, shape and number of the secondary air pipe(s) 60, the angle at which secondary air immediately exits the exit aperture(s) 64 relative to the ground, and the location of the secondary air passage 74 are chosen to reduce the amount of particulate emissions emitted by the woodstove 10.

In certain embodiments, the woodstove 10 is a low emission woodstove 10. For example, optionally, as measured according to Method 28 of the U.S. Environmental Protection Agency, the weighted average emission rate of the woodstove 10 of certain embodiments of the present disclosure is no greater than about 4.5 grams of particulate emissions per hour as compared to the EPA limit of 7.5 grams per hour for noncatalytic woodstoves and 4.1 grams per hour for catalytic woodstoves. Optionally, as measured according to Method 28 of the U.S. Environmental Protection Agency, the weighted average emission rate of the woodstove 10 of certain embodiments of the present disclosure is no greater than about 2 grams of particulate emissions per hour.

Method 28 of the U.S. Environmental Protection Agency measures particulate emissions by one of four methods, Methods 5H, 5G-1, 5G-2 and 5-G3, at multiple burn rates to arrive at a weighted average emission rate for a woodstove.

Method 5H is described in "Determination of Particulate Matter Emissions from Wood Heaters from a Stack Location" (February 2000), which is available at http://www.epa.gov/ttn/emc/promgate/m-05h.pdf and is incorporated in reference herein in its entirety. In Method 5H, particulate matter is withdrawn proportionally from the woodstove exhaust and is collected on two glass fiber filters separated by impingers immersed in an ice water bath. The first filter is maintained at a temperature of no greater than 120° C. The second filter and the impinger system are cooled such that the temperature of the gas exiting the second filter is no greater than 20° C. The particulate mass collected in the probe, on the filters, and in the impingers is determined gravimetrically after the removal of uncombined water. Methods 5G-1, 5-G-2 and 5G-3 are described in "Determination of Particulate Matter Emissions from Wood Heaters (Dilution Tunnel Sampling Location)" (February 2000), which is available at http://www.epa.gov/ttn/emc/promgate/m-05g.pdf and is incorporated by reference herein in its entirety. Method 5G-1, 5-G-2 and 5G-3 all use a dilution tunnel and differ from each other in the sampling train approaches, with 5G-1 using one dual-filter dry sampling train operated at about 0.015 $m^3$/min (0.5 cfm), 5G-2 using one dual-filter plus impingers sampling train operated at 0.015 $m^3$/min (0.5 cfm), and with 5G-3 using two dual-filter dry sampling trains operated simultaneously at any flow rate. In Methods 5G-1 and Method 5-G3, the measured particulate rate is then adjusted according to a specified formula set forth in Section 12.6.

For purposes of the present invention, when it is said that, as measured according to Method 28 of the U.S. Environmental Protection Agency, the weighted average emission rate of the woodstove 10 of certain embodiments of the present disclosure is no greater than about 4.5 grams of particulate emissions per hour, it is meant that the weighted average emission rate of the woodstove 10 of certain embodiments of the present disclosure is no greater than about 4.5 grams of particulate emissions per hour, as measured by Method 5G-1 (after adjustment per the formula specified in Section 12.6), Method 5G-2, Method 5G3 (after adjustment per the formula specified in Section 12.6) or Method 5H, whichever leads to a lower weighted average emission rate in grams per hour as compared to the Washington State limit of 4.5 grams of particulate emissions per hour. Similarly, when it is said that, as measured according to Method 28 of the U.S. Environmental Protection Agency, the weighted average emission rate of the woodstove 10 of certain embodiments of the present disclosure is no greater than about 2 grams of particulate emissions per hour, it is meant that the weighted average emission rate of the woodstove 10 of certain embodiments of the present disclosure is no greater than about 2 grams of particulate emissions per hour, as measured by Method 5G-1 (after adjustment per the formula specified in Section 12.6), Method 5G-2, Method 5G-3 (after adjustment per the formula specified in Section 12.6) or Method 5H, whichever leads to a lower weighted average emission rate in grams per hour.

Optionally, as the woodstoves 10 of certain embodiments of the present invention produce low emissions notwithstanding their heat output capacity, in certain embodiments, the woodstove 10 has a heat output capacity of approximately 120,000 BTU's (i.e., the woodstove 10 has a design specification of 120,000 BTU's with a tolerance range).

Optionally, as the woodstoves 10 of certain embodiments produce low emissions without a catalytic combuster, in certain embodiments, the woodstove 10 does not include a catalytic combuster.

Optionally, the woodstove 10 further includes a flue 76 in gaseous communication with the firebox 26 so that emissions generated by a fire located in the firebox 26 can ultimately exit the woodstove 10.

In some embodiments, the woodstove 10 is a free standing wood stove. The term "free standing" as used herein is intended to define the type of woodstove which is complete in and of itself. For example, a free standing woodstove need not necessarily be positioned within or be used in combination with any other type of stove or fireplace. It may be advantageous in some instances, however, to utilize a fireplace flue stack in the event the woodstove is going to be positioned in the vicinity of a fireplace.

An exemplary mode of operation of the woodstove 10 is now illustrated below. It will be understood that the method of operation is only exemplary.

A woodstove 10 is provided. See FIG. 1. The fuel loading door 40 is opened and a fuel source is loaded into the firebox 26 through the fuel loading opening 38. The fuel door 40 is closed. Primary air is flowed through the primary air aperture 44. The fuel source is ignited and emits a combustible gas. Primary air flows through the primary air aperture 44 and secondary air flows through one or more secondary air apertures 46 located in the air regulator 42, depending on whether the secondary air damper 48 is in the high burn or low burn position. The fire continues to burn and the primary air supports primary combustion and the secondary air supports secondary combustion. See FIGS. 3, 4 and 6.

Figure 5:
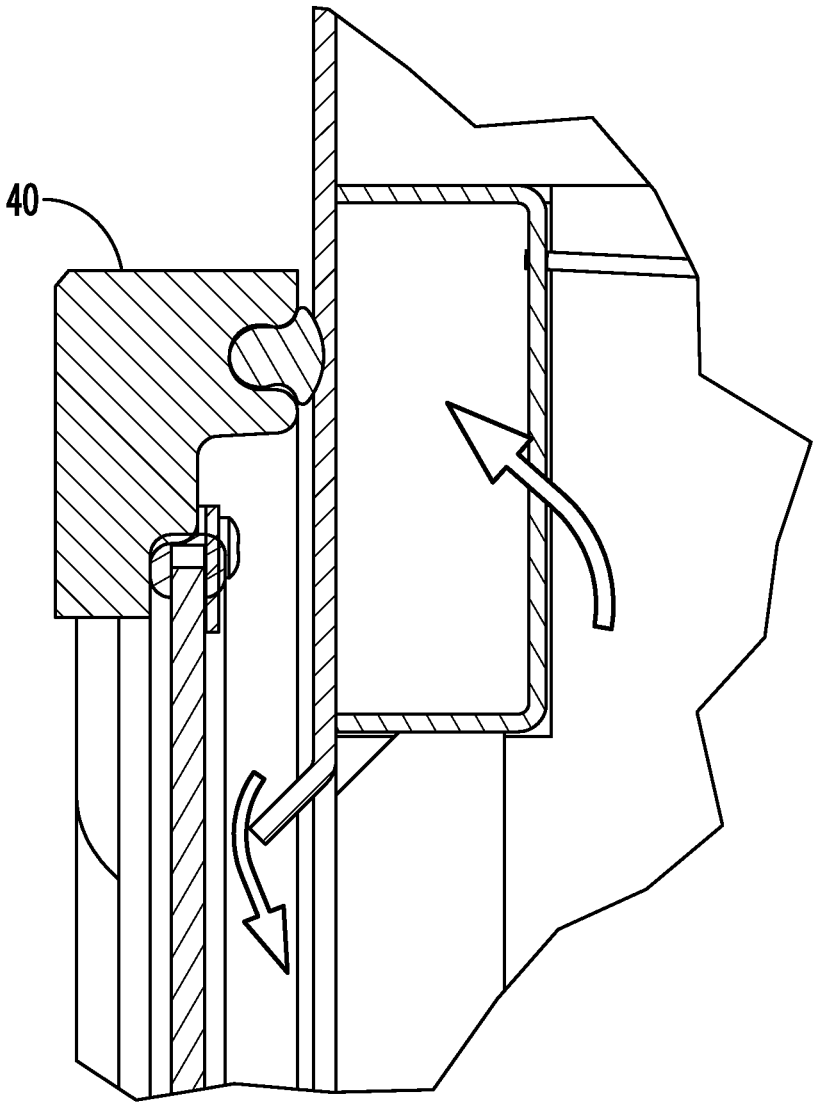
FIG. 5 illustrates a side, cross-sectional view of a front portion of the woodstove of FIG. 2, taken along line 5 in FIG. 2; arrows have been used to illustrate primary air movement.

Optionally, as illustrated in FIGS. 3 and 5, part of the primary air entering the woodstove 10 flows over the glass in the fuel loading door 40 to keep soot from forming on the glass.

EXAMPLE 1

The following example is provided to illustrate some embodiments of the woodstove of the present disclosure but should not be interpreted as any limitation thereon. Other embodiments within the scope of the claims herein will be apparent to one skilled in the art from the consideration of the specification or practice of the woodstove or methods disclosed herein. It is intended that the specification, together with the example, be considered to be exemplary only, with the scope and spirit of the disclosure being indicated by the claims which follow the example.

A woodstove having the components shown in FIGS. 9A and 9B was assembled.

The floor 24 of the woodstove housing 12 was placed on a flat surface. The firebox 26 had a usable volume of 3 cubic feet. The woodstove 10 had a heat output capacity of about 120,000 BTU's. In addition, as shown in FIGS. 9A and 9B, the primary air aperture 44 was pentagonal, the front secondary air aperture 46*a* was triangular and the rear secondary air aperture 46*b* was rectangular. The dimensions of the front secondary air aperture 46*a* were 1.75 inches in length and 1.5 inches in height to give a total surface area of 1.3125 inches, the dimensions of the rear secondary air aperture 46*b* were 2.2 inches in length and 0.95 inches in width to give a total surface area of 2.09 inches and the dimensions of the primary air aperture 44 were as follows: 1 inch in width and 2.640 inches in length for the rectangular portion of the pentagon and a base of 2.640 in length and a height of 1.917 inches for the triangular portion of the pentagon to give a total surface area of 5.17044 inches for the primary air aperture 44.

The woodstove 10 included four, cylindrical secondary air pipes, designated 60*a*, 60*b*, 60*c*, and 60*d* , with the letters a-d running from the front to the rear of the woodstove 10. As above, the components of each secondary air pipe (e.g., the entrance and exit apertures and longitudinal axis) will be similarly designated with the letters a, b, c, and d to indicate which secondary air pipe the component corresponds to.

The first and second front and first rear secondary air pipes 60*a*, 60*b* and 60*c* were part number 86645 commercially available from United States Stove Co. (South Pittsburg, Tenn.) and the second rear secondary air pipe 60*d* was part number 86643 commercially available from United States Stove Co. Each 86643 and 86645 tube had a length of 23.25 inches. The 86643 and 86645 tubes each included twenty-nine, circular exit apertures 64 equally spaced along the secondary air pipe length 68, two circular pipe fastener apertures 82 each configured to receive a pipe fastener 84 for attaching the secondary air pipe 60 to the housing 12, and two entrance apertures 62 at each end, as illustrated in FIGS. 12 and 13. The diameter of each exit aperture 64*a*, 64*b*, and 64*c* and each fastener aperture 82*a*, 82*b*, and 82*c* was 0.219 inches for each 86645 secondary air pipe 60*a*, 60*b*, and 60*c* and the diameter of each entrance aperture for each 86645 secondary air pipe 60*a*, 60*b*, and 60*c* was 0.745 inches. The diameter of each exit aperture 64*d* and each fastener aperture 82*d* was 0.156 inches for the 86643 secondary air pipe 60*d* and the diameter of each entrance aperture 62*d* for the 86643 secondary air pipe 60*d* was 0.745 inches.

The secondary air pipes 60*a*, 60*b*, 60*c*, and 60*d* were spaced 4 inches apart, the first front secondary air pipe 60*a* was disposed 13.8 inches above the firebox floor 28 within the housing 12, the second front secondary air pipe 60*b* was disposed 13.4 inches above the firebox floor 28 within the housing 12, the first rear secondary air pipe 60*c* was disposed 13.1 inches above the firebox floor 28 within the housing 12, and the second rear secondary air pipe 60*d* was disposed 12.8 inches above the firebox floor 28 within the housing 12.

The first front secondary air pipe 60*a* was positioned in the housing 12 such that lines drawn perpendicularly from the secondary air pipe longitudinal axis 70*a* through the center 72*a* of each exit aperture 64*a* of secondary air pipe 60*a* were at a −25 angle relative to the ground, the second front secondary air pipe 60*b* was positioned in the housing 12 such that lines drawn perpendicularly from the secondary air pipe longitudinal axis 70*b* through the center 72*b* of each exit aperture 64*b* of secondary air pipe 60*b* were at a −25 degree angle relative to the ground, the first rear secondary air pipe 60*c* was positioned in the housing 12 such that lines drawn perpendicularly from the secondary air pipe longitudinal axis 70*c* through the center 72*c* of each exit aperture 64*c* of secondary air pipe 60*c* were at a −10 degree angle relative to the ground, and the second rear secondary air pipe 60*d* was positioned in the housing 12 such that lines drawn perpendicularly from the secondary air pipe longitudinal axis 70*d* through the center 72*d* of each exit aperture 64*d* of secondary air pipe 60*d* were at a +5 degree angle relative to the ground, wherein a negative angle represents a line directed downwardly relative to the ground and the firebox floor 28 and a positive angle represents a line drawn upwardly relative to the ground and the firebox floor 28, as shown in FIG. 2.

As measured according to Methods 28 and 5H of the U.S. Environmental Protection Agency, the weighted average emission rate of the woodstove 10 was 1.9 grams of particulate emissions per hour.

Thus it is seen that the apparatuses and methods of the present invention readily achieve the ends and advantages mentioned as well as those inherent therein. While certain preferred embodiments of the invention have been illustrated and described for purposes of the present disclosure, numerous changes in the arrangement and construction of components and the order of steps of the methods herein may be made by those skilled in the art, which changes are encompassed within the scope and spirit of the present invention as defined by the appended claims.

What is claimed is:

1. An air regulator for a woodstove having a housing and a firebox disposed in the housing, said air regulator comprising:

a primary air aperture in the air regulator configured to supply primary air to a fire located in the firebox; and a plurality of secondary air apertures in the air regulator configured to supply secondary air to a combustible gas in the firebox emitted by the fire, wherein a first secondary air aperture of the plurality of secondary air apertures has a shape or size different than a shape or size of a second secondary air aperture of the plurality of secondary air apertures.

2. An air regulator for a woodstove having a housing and a firebox disposed in the housing, said air regulator comprising:

a primary air aperture in the air regulator configured to supply primary air to a fire located in the firebox, a first secondary air aperture in the air regulator configured to supply secondary air to a combustible gas in the firebox emitted by the fire; and a secondary air damper, the secondary air damper having a low burn position and a high burn position, wherein the secondary air damper covers a larger portion of the first secondary air aperture in the low burn position than in the high burn position.

3. A method of operating a woodstove having a housing, a firebox disposed in the housing, and an air regulator, the method comprising:

igniting a fuel source to create a fire in the firebox emitting a combustible gas; and flowing primary air through a primary air aperture of the air regulator and into the firebox toward the fuel source; and flowing secondary air through a first secondary air aperture in the air regulator, through an entrance aperture in a secondary air pipe of the woodstove, into the secondary pipe, and through an exit aperture in the secondary air pipe into the firebox such that secondary air exiting the exit aperture directly mixes with the combustible gas, wherein a size and shape of the first secondary air aperture is modified by a secondary air damper.

4. The method of claim 3, wherein the air regulator further comprises a separation plate extending from the air regulator floor, the separation plate creating a seal within the air regulator such that air entering the primary air aperture cannot mix with air entering the secondary air apertures within the air regulator.

5. The method of claim 3, wherein the air regulator further comprises a primary air damper and the primary air damper has a low burn position in which the primary air damper covers a maximum portion of the primary air aperture and a high burn position in which the primary air damper covers a minimum portion of the primary air aperture.

6. The method of claim 3, wherein:

as measured according to Method 28 of the U.S. Environmental Protection Agency, the weighted average emission rate of the woodstove is no greater than about 4.5 grams of particulate emissions per hour;

the woodstove further comprises a fuel loading opening configured to load a fuel source into the firebox and a fuel loading door to open and close the fuel loading opening;

the firebox has a usable volume of at least about 3 cubic feet;

the woodstove is a free standing woodstove; and the secondary air pipe is generally cylindrical in shape.

7. The method of claim 3, wherein, as measured according to Method 28 of the U.S. Environmental Protection Agency, the weighted average emission rate of the woodstove is no greater than about 2 grams of particulate emissions per hour.

8. The method of claim 3, further comprising heating the secondary air to at least 800 degrees Fahrenheit before the secondary air exists the exit aperture, and wherein flowing secondary air comprising flowing secondary air through a second secondary air aperture having a size or shape different from a size or shape of the first secondary air aperture.

9. A woodstove having a housing and a firebox disposed in the housing, said woodstove comprising:

an air regulator comprising:

a primary air aperture in the air regulator configured to supply primary air to a fire located in the firebox, a first secondary air aperture in the air regulator configured to supply secondary air to a combustible gas in the firebox emitted by the fire; and a secondary air damper, the secondary air damper having a low burn position and a high burn position, wherein the secondary air damper covers a larger portion of the first secondary air aperture in the low burn position than in the high burn position.

10. The woodstove of claim 9, wherein:

the air regulator further comprises an air regulator floor;

the primary air aperture is located in the air regulator floor;

the first secondary air aperture is located in the air regulator floor;

the woodstove further comprises a secondary air pipe comprising:

an entrance aperture configured to receive secondary air from the first secondary air aperture of the air regulator and allow secondary air to enter the secondary air pipe; and an exit aperture configured to allow secondary air to exit the secondary air pipe and directly mix with the combustible gas in the firebox, wherein the secondary air exits the exit aperture at a temperature of at least 800 degrees Fahrenheit;

the air regulator further comprises a separation plate extending from the air regulator floor, the separation plate creating a seal within the air regulator such that air entering the primary air aperture cannot mix with air entering the first secondary air aperture within the air regulator;

the primary air aperture supplies primary air to the fire located in the firebox by supplying air to a fuel source in the firebox; and wherein the air regulator further comprises a second secondary air aperture in the air regulator floor of the air regulator, wherein the second secondary air aperture has a size or a shape different from a size or a shape of the first secondary air aperture.

11. The woodstove of claim 10, wherein the firebox comprises a firebox floor configured to receive a fuel source, wherein the housing comprises a housing floor configured to position the woodstove on a surface, and the secondary air pipe is disposed above the firebox floor when the housing floor is positioned on a flat surface.

12. The woodstove of claim 9, wherein:

as measured according to Method 28 of the U.S. Environmental Protection Agency, the weighted average emission rate of the woodstove is no greater than about 2 grams of particulate emissions per hour; and the woodstove has a heat output capacity of at least about 120,000 BTU's.

13. The woodstove of claim 9, wherein the air regulator further comprises a primary air damper and the primary air damper has a low burn position and a high burn position, wherein the primary air damper covers a larger portion of the primary air aperture in the low burn position than in the high burn position.

14. The woodstove of claim 13, wherein:

the primary air damper is operably connected to the secondary air damper such that when the primary air damper is in the high burn position, the secondary air damper is in the high burn position and when the primary air damper is in the low burn position, the secondary air damper is in the low burn position;

the primary air damper covers a maximum portion of the primary air aperture in the low burn position;

the primary air damper covers a minimum portion of the primary air aperture in the high burn position;

the secondary air damper covers a maximum portion of the first secondary air aperture in the low burn position; and the secondary air damper covers a minimum portion of the first secondary air aperture in the high burn position.

15. The woodstove of claim 13, wherein:

the primary air damper covers a maximum portion of the primary air aperture in the low burn position;

the primary air damper covers a minimum portion of the primary air aperture in the high burn position;

the secondary air damper covers a maximum portion of the first secondary air aperture in the low burn position;

the secondary air damper covers a minimum portion of the first secondary air aperture in the high burn position; and the secondary air damper covers a portion of the second secondary air aperture in the low burn position.

16. The woodstove of claim 9, wherein the woodstove comprises a plurality of secondary air pipes and each secondary air pipe comprises a plurality of exit apertures, and each of the secondary air pipes of the plurality of secondary air pipes is generally cylindrical in shape.

17. The woodstove of claim 16, wherein the housing comprises a housing floor configured to position the woodstove on a surface, wherein the firebox comprises a firebox floor configured to receive a fuel source, and wherein the secondary air pipes are positioned such that, for a majority of the exit apertures, secondary air immediately exiting the exit apertures is directed at an angle of between about −35 degrees and about +15 degrees relative to the ground when the housing floor is positioned on a flat surface, wherein a negative angle represents secondary air directed downwardly relative to the ground and a positive angle represents secondary air directed upwardly relative to the ground, and wherein the air regulator is located substantially below the firebox floor.

18. The woodstove of claim 9, wherein:

The woodstove has a heat output capacitor of at least about 120,000 BTU's;

the woodstove is a free standing woodstove;

as measured according to Method 28 of the U.S. Environmental Protection Agency, the weighted average emission rate of the woodstove is no greater than about 4.5 grams of particulate emissions per hour;

the firebox has a usable volume of at least 3 cubic feet;

the woodstove further comprises a fuel loading opening configured to load a fuel source into the firebox; and the woodstove further comprises a fuel loading door to open and close the fuel loading opening.

19. A woodstove having a housing and a firebox disposed in the housing, said woodstove comprising:

an air regulator comprising:

a primary air aperture in the air regulator configured to supply primary air to a fire located in the firebox; and a plurality of secondary air apertures in the air regulator configured to supply secondary air to a combustible gas in the firebox emitted by the fire, wherein a first secondary air aperture of the plurality of secondary air apertures has a shape or size different than a shape or size of a second secondary air aperture of the plurality of secondary air apertures, wherein:

the air regulator further comprises an air regulator floor;

the primary air aperture is located in the air regulator floor;

the plurality of secondary air apertures are located in the air regulator floor;

the air regulator further comprises a secondary air damper, the secondary air damper having a low burn position and a high burn position, wherein the secondary air damper covers a larger portion of the first secondary air aperture in the low burn position than in the high burn position;

the woodstove further comprises a secondary air pipe comprising:

an entrance aperture configured to receive secondary air from the plurality of secondary air apertures of the air regulator and allow secondary air to enter the secondary air pipe; and an exit aperture configured to allow secondary air to exit the secondary air pipe and directly mix with the combustible gas in the firebox, wherein the secondary air exits the exit aperture at a temperature of at least 800 degrees Fahrenheit;

the air regulator further comprises a separation plate extending from the air regulator floor, the separation plate creating a seal within the air regulator such that air entering the primary air aperture cannot mix with air entering the secondary air apertures within the air regulator; and the primary air aperture supplies primary air to the fire located in the firebox by supplying air to a fuel source in the firebox.

20. The woodstove of claim 19, wherein the firebox comprises a firebox floor configured to receive a fuel source, wherein the housing comprises a housing floor configured to position the woodstove on a surface, and wherein the secondary air pipe is disposed above the firebox floor when the housing floor is positioned on a flat surface.

21. The woodstove of claim 19, wherein the air regulator further comprises a primary air damper and the primary air damper has a low burn position and a high burn position, wherein the primary air damper covers a larger portion of the primary air aperture in the low burn position than in the high burn position.

22. The woodstove of claim 21, wherein:

the primary air damper is operably connected to the secondary air damper such that when the primary air damper is in the high burn position, the secondary air damper is in the high burn position and when the primary air damper is in the low burn position, the secondary air damper is in the low burn position;

the primary air damper covers a maximum portion of the primary air aperture in the low burn position; and the primary air damper covers a minimum portion of the primary air aperture in the high burn position.

23. The woodstove of claim 19, wherein:

the primary air damper covers a maximum portion of the primary air aperture in the low burn position;

the primary air damper covers a minimum portion of the primary air aperture in the high burn position;

the secondary air damper covers a maximum portion of the first secondary air aperture in the low burn position;

the secondary air damper covers a minimum portion of the first secondary air aperture in the high burn position; and the secondary air damper covers a portion of the second secondary air aperture in the low burn position.

24. The woodstove of claim 19, wherein the woodstove comprises a plurality of secondary air pipes, each secondary air pipe comprises a plurality of exit apertures, and each of the secondary air pipes of the plurality of secondary air pipes is generally cylindrical in shape.

25. The woodstove of claim 24, wherein the housing comprises a housing floor configured to position the woodstove on a surface, wherein the firebox comprises a firebox floor configured to receive a fuel source, and wherein the secondary air pipes are positioned such that, for a majority of the exit apertures, secondary air immediately exiting the exit apertures is directed at an angle of between about −35 degrees and about +15 degrees relative to the ground when the housing floor is positioned on a flat surface, wherein a negative angle represents secondary air directed downwardly relative to the ground and a positive angle represents secondary air directed upwardly relative to the ground, and wherein the air regulator is located substantially below the firebox floor.

26. The woodstove of claim 19, wherein the total surface area of the secondary air apertures that is not covered by the secondary air damper when the secondary air damper is in the high burn position is at least about 3 square inches.

27. The woodstove of claim 19, wherein, as measured according to Method 28 of the U.S. Environmental Protection Agency, the weighted average emission rate of the woodstove is no greater than about 4.5 grams of particulate emissions per hour.

28. The woodstove of claim 27, wherein the woodstove further comprises a fuel loading opening configured to load a fuel source into the firebox and a fuel loading door to open and close the fuel loading opening and wherein the firebox has a usable volume of at least about 3 cubic feet.

29. The woodstove of claim 27, wherein the woodstove has a heat output capacity of at least about 120,000 BTU's.

30. The woodstove of claim 19, wherein, as measured according to Method 28 of the U.S. Environmental Protection Agency, the weighted average emission rate of the woodstove is no greater than about 2 grams of particulate emissions per hour.

31. The woodstove of claim 19, wherein the woodstove is a free standing woodstove.

* * * * *